US005757145A

United States Patent [19]

Johnson et al.

[11] Patent Number: 5,757,145

[45] Date of Patent: May 26, 1998

[54] DIMMING CONTROL SYSTEM AND METHOD FOR A FLUORESCENT LAMP

[75] Inventors: Samuel A. Johnson, Eagle; Dan E. Rothenbuhler, Meridian, both of Id.

[73] Assignee: Beacon Light Products, Inc., Meridian, Id.

[21] Appl. No.: 616,541

[22] Filed: Mar. 15, 1996

Related U.S. Application Data

[63] Continuation-in-part of Ser. No. 258,007, Jun. 10, 1994, Pat. No. 5,537,010, and Ser. No. 404,880, Mar. 16, 1995, Pat. No. 5,504,398, and Ser. No. 406,183, Mar. 16, 1995.

[51] Int. Cl.[6] ..... G05F 1/00

[52] U.S. Cl. ..... 315/308; 315/307; 315/DIG. 4; 315/194; 315/293

[58] Field of Search ..... 315/308, 307, 315/194, 199, 293, 292, 316, 360, DIG. 4, 106, 282, 289, 290

[56] References Cited

U.S. PATENT DOCUMENTS

| | | | |
|---|---|---|---|
| Re. 35,220 | 4/1996 | Johnson | 315/208 |
| 3,851,209 | 11/1974 | Murakami et al. | 315/99 |
| 3,927,345 | 12/1975 | Licata et al. | 315/DIG. 5 |
| 3,990,000 | 11/1976 | Digneffe | 315/292 X |
| 4,107,579 | 8/1978 | Bodine, Jr. et al. | 315/205 |
| 4,733,138 | 3/1988 | Pearlman et al. | 315/307 |
| 4,870,340 | 9/1989 | Kral | 323/235 |
| 5,264,761 | 11/1993 | Johnson | 315/291 |
| 5,504,398 | 4/1996 | Rothenbuhler | 315/209 R |
| 5,537,010 | 7/1996 | Johnson et al. | 315/289 |

FOREIGN PATENT DOCUMENTS

| | | |
|---|---|---|
| A 46395 | 2/1982 | European Pat. Off. . |
| A 471215 | 2/1992 | European Pat. Off. . |
| A 2517211 | 10/1976 | Germany . |
| WO A 9535646 | 12/1995 | WIPO . |

OTHER PUBLICATIONS

Startlight TN22 Preliminary Data Sheet, *SGS–Thompson Microelectronics*, Nov., 1991, pp. 1/5–5/5.

*Primary Examiner*—Robert Pascal
*Assistant Examiner*—Haissa Philogene
*Attorney, Agent, or Firm*—John R. Ley

[57] ABSTRACT

The illumination intensity of a fluorescent lamp is controlled in response to control signals generated at a remote location on the power supply conductors of a lamp circuit and decoding those control signals at the fluorescent lamp to control the illumination intensity. A dimming controller is connected in the lamp circuit remote from the lamp and generates first and second control signals indicative of a request to increase or decrease, respectively, the lamp illumination intensity. The control module is connected in the lamp circuit to fluorescent lamp and the control module receives the control signals. The control module continually increases and decreases the illumination intensity of the lamp in response to the first and second control signals, respectively. The illumination intensity is controlled by adjusting a time point within each half-cycle of applied power where the lamp is extinguished. A third control signal generated by the dimming controller and decoded by the control module ceases the adjustment in the extinguishing point.

21 Claims, 8 Drawing Sheets

RESET
140
INITIALIZE
142
137
SET CYCLE COUNTER FOR WARM UP
144

146
CYCLE COUNTER LESS THAN WARM UP ?
YES
148
SET FIRING ANGLE FOR WARM UP
NO
150
CYCLE COUNTER LESS THAN IGNITE ?
YES
152
SET FIRING ANGLE FOR IGNITE
NO
SET FIRING ANGLE FOR PRESENT INTENSITY
153
154
HAS THERE BEEN A ZERO CROSS ?
YES
NO
156
END OF A PID ?
NO
YES
1
2

138
180
INTERRUPT
182
ZERO CROSSING ?
NO
YES
184
SET TO FULL INTENSITY ?
NO
YES
186
SET INTERRUPT TIMER FOR LAMP CHECK
191
SET INTERRUPT TIMER FOR FIRING TIME
INCREMENT CYCLE COUNTER
188
RETURN FROM INTERRUPT
190
192
PID OR LAMP CHECK ?
YES
NO
194
CYCLE COUNTER LESS THAN WARM UP?
NO
YES
196
CYCLE COUNTER IS ODD ?
NO
YES
FIRE THYRISTOR
198
SET INTERRUPT TIMER FOR REMAINDER OF HALF CYCLE
200
RETURN FROM INTERRUPT
202
3

DIMMING CONTROL SYSTEM AND METHOD FOR A FLUORESCENT LAMP

CROSS REFERENCE TO RELATED APPLICATIONS

This is a continuation-in-part of U.S. patent application Ser. No. 08/258,007 for "Solid State Starter for Fluorescent Lamp" filed Jun. 10, 1994, now U.S. Pat. No. 5,537,010; Ser. No. 08/404,880 for "Dimming Controller for a Fluorescent Lamp," filed Mar. 16, 1995, now U.S. Pat. No. 5,504,398; and Ser. No. 08/406,183 for "Method for Dimming a Fluorescent Lamp," filed Mar. 16, 1995.

This invention relates to fluorescent lamps and other similar types of discharge lamps. More particularly, the present invention relates to a new and improved system and method for accurately controlling the illumination intensity of a fluorescent lamp over a wide continuum of user-selected illumination intensities, by generating control signals in the form of precisely timed power interruptions, decoding the power interruptions, and controlling the application of electrical power to cathodes of the fluorescent lamp in accordance with the control signals. Preferably the control signals are generated at a location remote from the lamp and communicated over the conventional electrical power supply conductors to the lamp.

The present invention may be used advantageously in conjunction with the inventions described in U.S. patent applications Ser. No. 08/531,037 for "Method of Regulating Lamp Current Through a Fluorescent Lamp by Pulse Energizing a Driving Supply", filed Sep. 19, 1995; Ser. No. 08/530,673 for "Preheating and Starting Circuit and Method for a Fluorescent Lamp," filed Sep. 19, 1995; and Ser. No. 08/530,563 for "Resonant Voltage-Multiplying, Current-Regulating and Ignition Circuit for a Fluorescent Lamp," filed Sep. 19, 1995.

The invention described in U.S. patent application Ser. No. (83,327) for "Automatic State Transition Controller for a Fluorescent Lamp," filed concurrently herewith may be used in conjunction with and in complement to the present invention.

The invention described in U.S. Pat. No. 5,030,390 for a "Two Terminal Incandescent Lamp Controller," issued Jul. 9, 1991 and now reissued as Re (083-301) is of background interest to the present invention as it relates to a control technique for incandescent lamps using momentary power interruptions as control signals. Furthermore, certain aspects of the present invention may be advantageously accomplished by using the invention described in U.S. patent application Ser. No. 08/257,877 for a "High Temperature, High Holding Current Semiconductor Thyristor," filed Sep. 9, 1994.

All of these U.S. patent applications are assigned to the assignee hereof. The information contained in all of the above identified applications is incorporated herein by this reference.

BACKGROUND OF THE INVENTION

There are many desirable features associated with fluorescent lamps, compared to incandescent lamps. For example, fluorescent lamps typically use substantially less electrical power and produce equal or greater illumination.

One of the drawbacks associated with fluorescent lamps is a relative difficulty in controlling the illumination intensity of the fluorescent lamp compared to the relative ease of controlling the illumination intensity of an incandescent lamp. Dimmers for fluorescent lamps are available, but prior fluorescent lamp dimmers which provide the relatively wide range of dimming capability are relatively expensive. Prior fluorescent dimmers which are relatively inexpensive are generally capable of providing only a few discrete illumination levels, such as high, medium, and low illumination intensities. The inexpensive prior dimmers are obviously not suitable for applications where a more precise control over the level of illumination intensity is desired. The more expensive dimmers are sometimes cost prohibitive.

The typical previous fluorescent dimmer uses an electronic ballast to deliver a continuous current to the cathodes of the fluorescent lamp to maintain the cathodes in a heated condition during dimming. During normal full-intensity operation, the current flowing between the cathodes in the fluorescent lamp is adequate to ignite a plasma within the lamp as well as maintain the cathodes in a heated condition for reliable ignition of the lamp with each succeeding half-cycle of applied AC power. However, when the illumination intensity is reduced by reducing the voltage and current flowing between the cathodes, the amount of cathode heating current is reduced. If the cathodes are not heated sufficiently, the lamp will not reliably ignite with each half-cycle of applied AC power. Therefore, the electronic ballast must supply a cathode heating current which is more or less independent of the voltage or current conditions which vary the illumination intensity. The necessity to control the heating current through the cathodes separately from the ignition or illumination current applied between the lamp cathodes has caused the relative expense. Furthermore, because of the difficulty in regulating the electrical conditions to maintain cathode heating while separately regulating the illumination intensity of the lamp, the typical previous fluorescent dimmer requires a separate control conductor to extend between a dimming controller and the electronic ballast associated with the lamp.

It is with respect to this and other background information that the present invention has evolved.

SUMMARY OF THE INVENTION

One of the important aspects of the present invention relates to a dimming controller which communicates with a control module to control the illumination intensity of a fluorescent lamp in a manner comparable to the convenience typical in controlling the illumination intensity of an incandescent lamp. Another aspect of this invention relates to a dimming technique which selectively varies the illumination intensity in a relatively wide range or continuum of intensities in a fluorescent lamp which is energized through a conventional magnetic ballast. Another aspect of this invention relates to a dimming technique which communicates control signals for controlling the illumination intensity of a fluorescent lamp between a remotely located dimming controller and a control module associated with a fluorescent lamp over conventional power supply conductors. Still another aspect of this invention relates to a simple control technique for controlling the illumination intensity of a fluorescent lamp using momentary power interruptions delivered to the lamp over the power supply conductors which energize the lamp.

In accordance with these and other aspects, the present invention is directed to a control system for use in controlling the illumination intensity of a fluorescent lamp. The fluorescent lamp has cathodes and a medium which is energized into a light-emitting plasma when energized by electrical energy supplied by an AC power source. The AC power is supplied in alternating half-cycles of AC voltage and AC current and is conducted through a lamp circuit which includes a ballast connected to the lamp. The control system includes a dimming controller and a control module. The dimming controller is adapted to be connected in the lamp circuit at a location remote from the fluorescent lamp. The control module is adapted to be connected to the cathodes of the fluorescent lamp. The dimming controller generates, and transmits over the power conductors of the fluorescent lamp circuit, a first control signal indicative of a request to increase the illumination intensity of the lamp and a second control signal indicative of a request to decrease the illumination intensity of the lamp. The control module receives the control signals transmitted from the dimming controller, and in response to the control signals, changes the illumination intensity of the lamp by selectively varying the portion of each half-cycle of applied AC power during which the medium is energized into the plasma. The proportion of each half cycle during which the medium is energized into the plasma is increased and decreased in response to the first and second control signals, respectively.

Furthermore, and in accordance with its preferred aspects, the dimming controller also generates a third control signal indicative of a request to cease varying the illumination intensity of the fluorescent lamp. The control ceases varying the proportion of each half-cycle during which the medium is energized into the plasma in response to receiving the third control signal. The dimming controller determines any difference between the actual illumination intensity value and the desired illumination intensity value, and generates one of the first control signal or the second control signal in response to the determined difference to regulate the illumination intensity from the lamp. The control module varies at a predetermined rate of change in the proportion of the each half-cycle in which the plasma is energized, and the dimming controller generates the third control signal at a predetermined time in reference to the predetermined rate of change. The control signals are preferably momentary interruptions in power of predetermined time duration created by the dimming controller and decoded by the control module.

In accordance with these and other aspects, the present invention also relates to a method of controlling the illumination intensity of a fluorescent lamp. The method involves the steps of generating first and second control signals on the lamp circuit at a location remote from the lamp. The first and second control signals are indicative of requests to increase and decrease the illumination intensity of the lamp, respectively. The illumination intensity of the lamp is increased and decreased in response to receiving the first and second control signal at the lamp, respectively. A third control signal is generated to indicate a request to cease changing the illumination intensity of the fluorescent lamp, and in response to the third control signal the change in the illumination intensity is ceased.

The dimming system and method selectively varies the illumination intensity in a relatively wide range or continuum of intensities in a fluorescent lamp circuit which includes a conventional magnetic ballast. The control signals are effectively communicated over the power supply conductors in the lamp circuit without the need for separate control conductors, thereby greatly simplifying the application of the system to existing fluorescent lamp circuits. The effectiveness of the dimming control over a fluorescent lamp by use of the present invention is comparable in convenience to the dimming control for a conventional fluorescent lamp.

A more complete appreciation of the present invention and its scope can be obtained by reference to the accompanying drawings, which are briefly summarized below, the following detailed description of presently preferred embodiments of the invention, and the appended claims.

DETAILED DESCRIPTION

Figure 1:
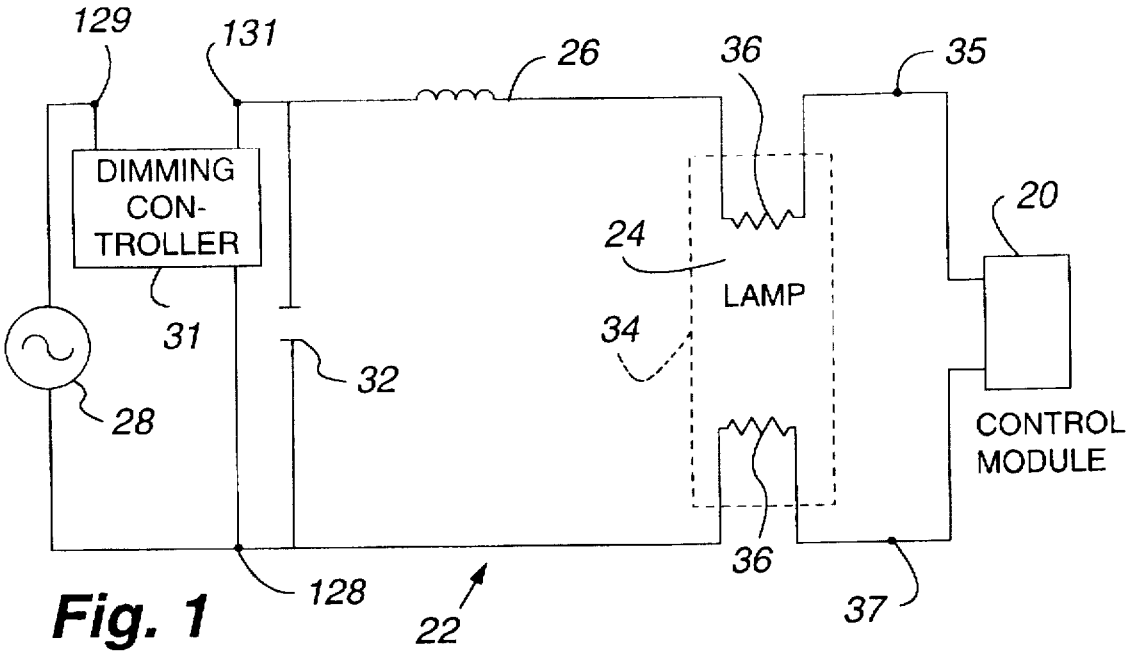
FIG. 1 is a simplified circuit diagram of a fluorescent lamp, a ballast, and a dimming controller and control module which incorporate the present invention for controlling the intensity of the fluorescent lamp, all of which is connected to a conventional AC power source.

The features of the present invention are preferably embodied in a dimming controller 31 that communicates control signals to a control module 20, and the control module 20 which decodes those control signals, both of which are connected in a fluorescent lamp circuit 22, as shown in FIG. 1. A fluorescent lamp 24 is connected in series with a current limiting inductor 26 known as a ballast in the circuit 22. Conventional alternating current (AC) power from a source 28 is supplied over conventional power supply conductors to the dimmer 31 and to the series connected lamp 24 and ballast 26. Typically the dimming controller 31 will be wall-mounted and will perform on/off power control functions as well as the dimming functions described below. A capacitor 32 is optional and may be connected in parallel with the series connected ballast 26 and fluorescent lamp 24 to establish a more favorable power factor.

The details concerning the elements of the fluorescent lamp circuit 22, and the role of the control module 20 in igniting the lamp 24 into a light emitting state and in extinguishing the lamp 24, are all described in detail in the above-identified U.S. patent applications. Some of the more relevant aspects of those details are next described as a basis for a more complete understanding of the present invention.

The fluorescent lamp 24 is formed conventionally, generally of an evacuated translucent housing 34 which has two filament electrodes known as cathodes 36 located at opposite ends of the housing 34. A small amount of mercury is contained within the evacuated housing 34. When the lamp 24 is lighted, the mercury is vaporized and ionized, and a current is conducted between the cathodes 36 through the mercury medium, thereby creating a light-emitting plasma. Due to the high conductivity, low resistance characteristics of the plasma medium, the ballast 26 is necessary to limit the current flow through the plasma to prevent the cathodes 36 from burning out.

The control module 20 is connected in series with and between the cathodes 36 at terminals 35 and 37. To light the lamp 24, the control module 20 establishes a closed series circuit through the cathodes 36 for a warmup time period during which AC current from the source 28 flows through both cathodes 36 and heats them. The heat from the cathodes 36 helps vaporize the mercury within the housing 34. The heated cathodes 36 also emit low work energy ions from a barium coating on the surface of the cathodes to assist further in establishing an ionized environment within the housing 34.

Figure 5:
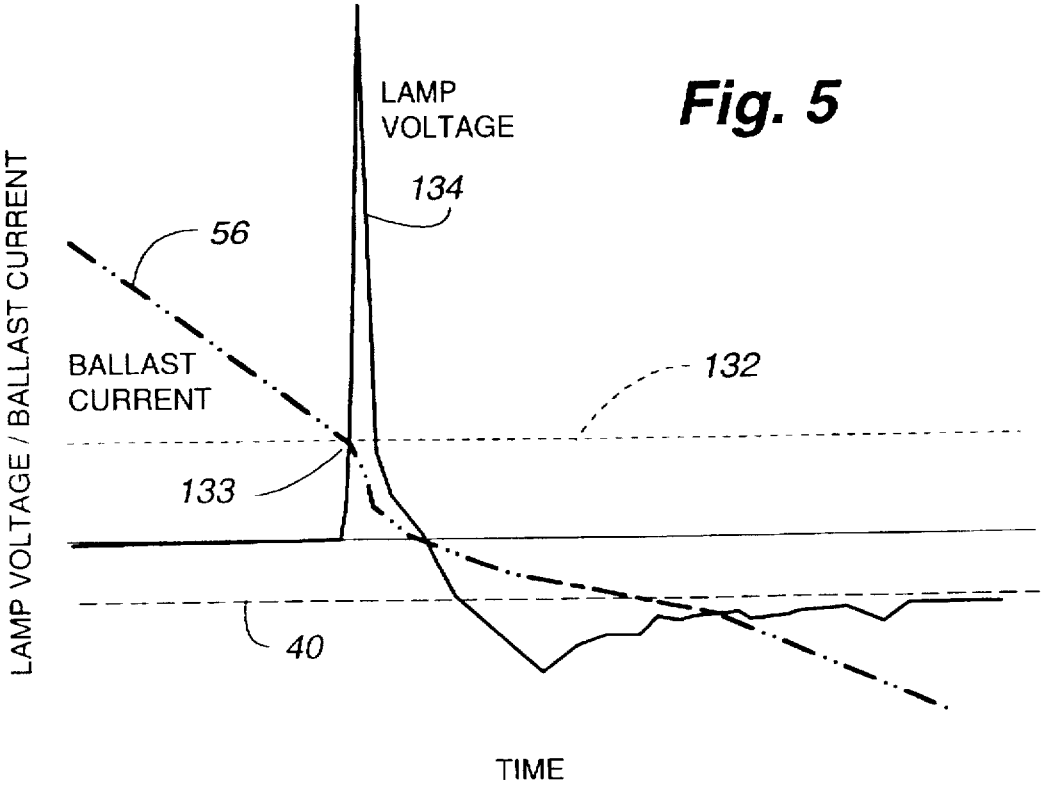
FIG. 5 is an enlarged waveform diagram which combines portions of the voltage and current waveforms shown in FIGS. 3A and 3B on a single axis to better illustrate the timing of a high voltage ignition pulse in relation to the current waveform and relative to the current holding level of a semiconductor thyristor.

After the warm-up time period, the control module ignites, lights or starts the lamp 24 during a relatively short ignition time period. The characteristics of a thyristor preferably contained in the control module causes an almost instantaneous termination of the current flow through the control module 20 when the AC current is at a significantly high value, resulting in a relatively high change in current in a relatively short amount of time (di/dt). The ballast 26 responds to the relatively high di/dt by producing a very high voltage ignition pulse 134 (FIG. 5). The voltage of the ignition pulse is sufficiently high to break down the partially ionized mercury vapor within the lamp housing 34, causing an arc to jump directly between the cathodes 36. The control module 20 is non-conductive at this time and no longer presents a current path between the cathodes 36. The current which flows between the cathodes more completely ionizes the mercury into the light emitting plasma.

Figure 2A:
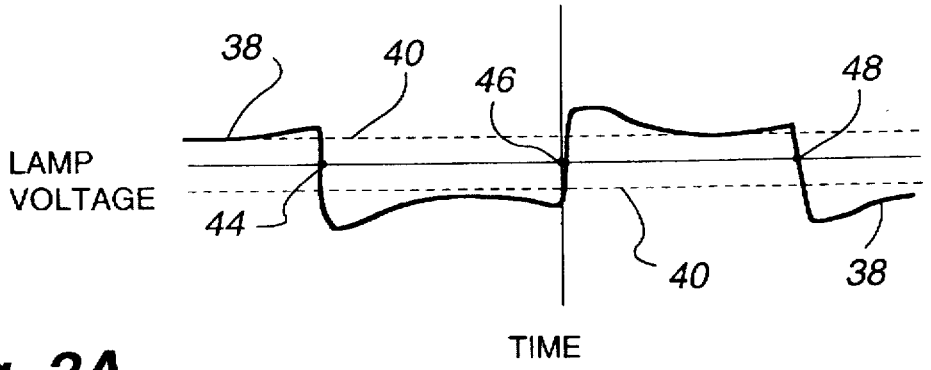
FIGS. 2A and 2B are waveform diagrams on a common time axis of the voltage appearing across the fluorescent lamp and the current conducted through the ballast, respectively, when the control module shown in FIG. 1 operates the fluorescent lamp at full intensity.

The ionization characteristics of the mercury plasma limit the voltage between the cathodes 36 to a characteristic operating voltage which is represented by the curve 38 shown in FIG. 2A. The characteristic operating voltage 38 is essentially equal to the ionization voltage of mercury shown by curve 40 in FIG. 2A. The characteristic operating voltage of the fluorescent lamp varies by the composition of the mercury medium within the housing. Furthermore the characteristic operating voltage is adjusted depending on the voltage of the applied power in which the lamp is used. For lamps used in conventional 120 volt AC applications, the characteristic operating voltage is usually in the neighborhood of 60 volts. For lamps used in 277 volt AC applications, the characteristic operating voltage is in the neighborhood of 125 volts.

Heating the cathodes 36 increases the ionization level of the mercury medium to an arc-sustaining level. The increased ionization from heating assures that the lamp will ignite on a reliable basis between sequential half-cycles of power applied from the source 28. The current which flows through the ballast 26 and the lamp 24 under these conditions is shown in FIG. 2B by curve 42.

Figure 2B:
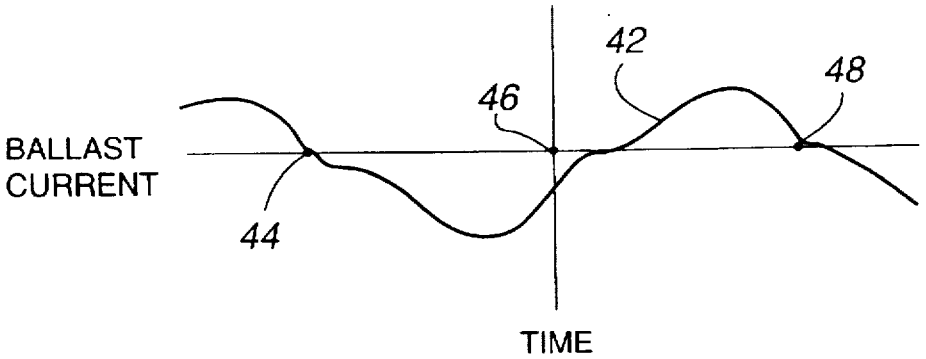

Points 44, 46 and 48 shown in FIGS. 2A and 2B represent the points where the AC voltage across the lamp 24 normally crosses the zero reference point represented by the horizontal axis in FIGS. 2A and 2B. The points 44, 46 and 48 thus represent the beginning and end of two consecutive half-cycles of applied AC voltage. When the lamp is operated in a fully illuminated condition as shown in FIG. 2A, the plasma is excited to the characteristic operating voltage 40 over almost the whole duration of each half-cycle.

The control module 20 varies the illumination intensity of the fluorescent lamp 24 by reducing or dimming the amount of illumination emitted during each half-cycle of applied AC power, compared to the maximum illumination intensity available by completely energizing the plasma during entire half-cycles. The dimming effect is achieved as a result of the control module 20 becoming conductive at a predetermined time point during each half-cycle of applied AC voltage across the cathodes 36. With the control module 20 conducts, the cathodes 36 are effectively connected together in series to short out the current path through the ionized mercury plasma between the cathodes. In this shorted-out condition, the plasma is immediately extinguished for the remaining portion of that half-cycle. After the zero crossing point at the end of the half-cycle in which the plasma was extinguished (e.g., a point 44, 46 or 48), the control module 20 again ignites the plasma. Later in that half-cycle, the control module again short circuits the cathodes together to extinguish the plasma.

Extinguishing the lamp before the end of each half-cycle reduces the average intensity of the illumination on an integrated continual basis. The on and off nature of the illumination from the lamp in not readily perceived by a human because the typical phosphor coating on the translucent lamp housing creates a visual persistive effect to integrate the bursts of illumination. Furthermore, the bursts of illumination occur at a high enough frequency (120 Hz for a conventional 60 Hz applied power or 100 Hz for conventional 50 Hz applied power) that the human eye does not readily distinguish the flashes. As a result, the illumination control is perceived as a smooth continuum of intensity levels over the operative dimming range of the control module.

Figure 3A:
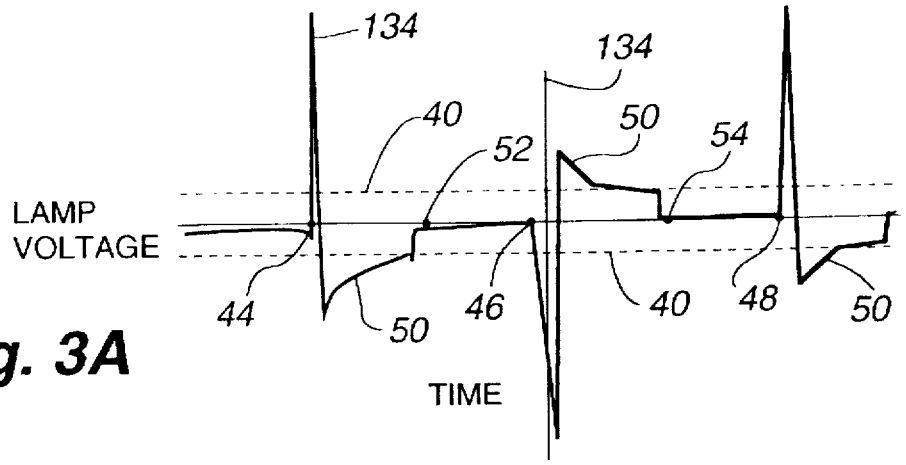
FIGS. 3A and 3B are waveform diagrams on a common time axis of the voltage appearing across the fluorescent lamp and the current conducted through the ballast, respectively, when the control module shown in FIG. 1 dims the fluorescent lamp to a power level which is approximately 50% of full intensity.
Figure 3B:
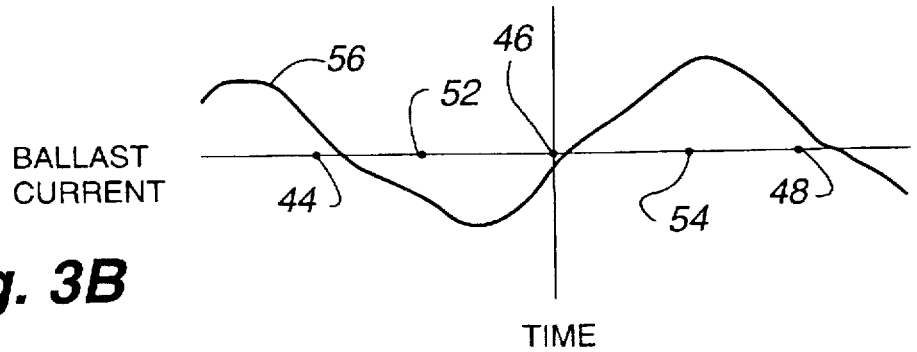

The dimming or illumination intensity control effect achieved by extinguishing the plasma before the end of a half-cycle is illustrated by FIGS. 3A and 3B, which are to be compared to FIGS. 2A and 2B. In one exemplary dimming situation shown in FIG. 3A, the voltage represented by the curve 50 is applied across the lamp cathodes 36 (FIG. 1). However at point 52, after the start at the zero crossing point 44 at the start of one half-cycle, the control module 20 conducts, causing the voltage of curve 50 to diminish to near zero at point 52. Point 52 occurs before the applied AC voltage reaches the next zero crossing point 46. At the beginning of the next half-cycle at point 46, the lamp is again ignited and thereafter extinguished at point 54, prior to the end of that voltage half-cycle at point 48. The ignition and extinguishing functions repeat in this manner, with the control module establishing the extinguishing points 52 and 54 prior to the end of each half-cycle of applied power. Unless the illumination intensity is adjusted, the extinguishing points 52 and 54 appear at the same relative locations in each subsequent half-cycle.

The predetermined extinguishing point of each half-cycle determines the amount of light produced or the intensity of the lamp, as perceived by the human eye. This predetermined point is also referred to herein as the "firing angle," which describes the conduction point in terms of degrees or angle within each 180 degree half-cycle.

Curve 56 shown in FIG. 3B represents the current through the ballast 26 (FIG. 1) under the conditions represented in FIG. 3A. By comparing the curve 56 in FIG. 3B with the curve 42 in FIG. 2B, it can be seen that the inductive characteristics of the ballast do not result in large changes in the current flowing through the circuit 22 (FIG. 1) in the two conditions represented in FIG. 2A or FIG. 3A. Since the current flow remains similar in both cases, the power or illumination from the lamp is generally related to the voltage across the lamp as shown in FIG. 2A and 3A. Comparing FIG. 3A with FIG. 2A, it is apparent that the area between the curve 50 and the horizontal reference axis is considerably smaller than the area between curve 38 and the horizontal axis. For example, curve 50 may represent a fifty percent dimming factor in relation to the full intensity curve 38.

The control module 20 includes a high holding current thyristor 70, triac, or other type of semiconductor current switching device. A microcontroller 72, or other microprocessor, logic circuit or state machine, controls the conduction of the thyristor, in accordance with information which has been preprogrammed into it and in accordance with input control signals supplied by the dimming controller 31 (FIG. 1). The control signals are preferably in the form of short power interruptions which the dimming controller 31 (FIG. 1) delivers over the interconnecting power conductors of the circuit 22.

The microcontroller detects the input control power interruptions as power interrupt detections (PIDs). The microcontroller decodes the sequences and time durations of PIDs as input control information which causes microcontroller to respond according to the information which has been programmed into the microcontroller.

The control information communicated by the PIDs allows the user to completely turn off the lamp, to turn on the lamp, and to increase and decrease the intensity of illumination from the lamp over a broad continuum of intensities. The functionality of the control module 20 (FIG. 1) is illustrated by the flow charts shown in FIGS. 7A, 7B, 8A AND 8B. The functionality of the dimming controller 31 (FIG. 1) is illustrated by the flow chart shown in FIG. 9.

Figure 4:
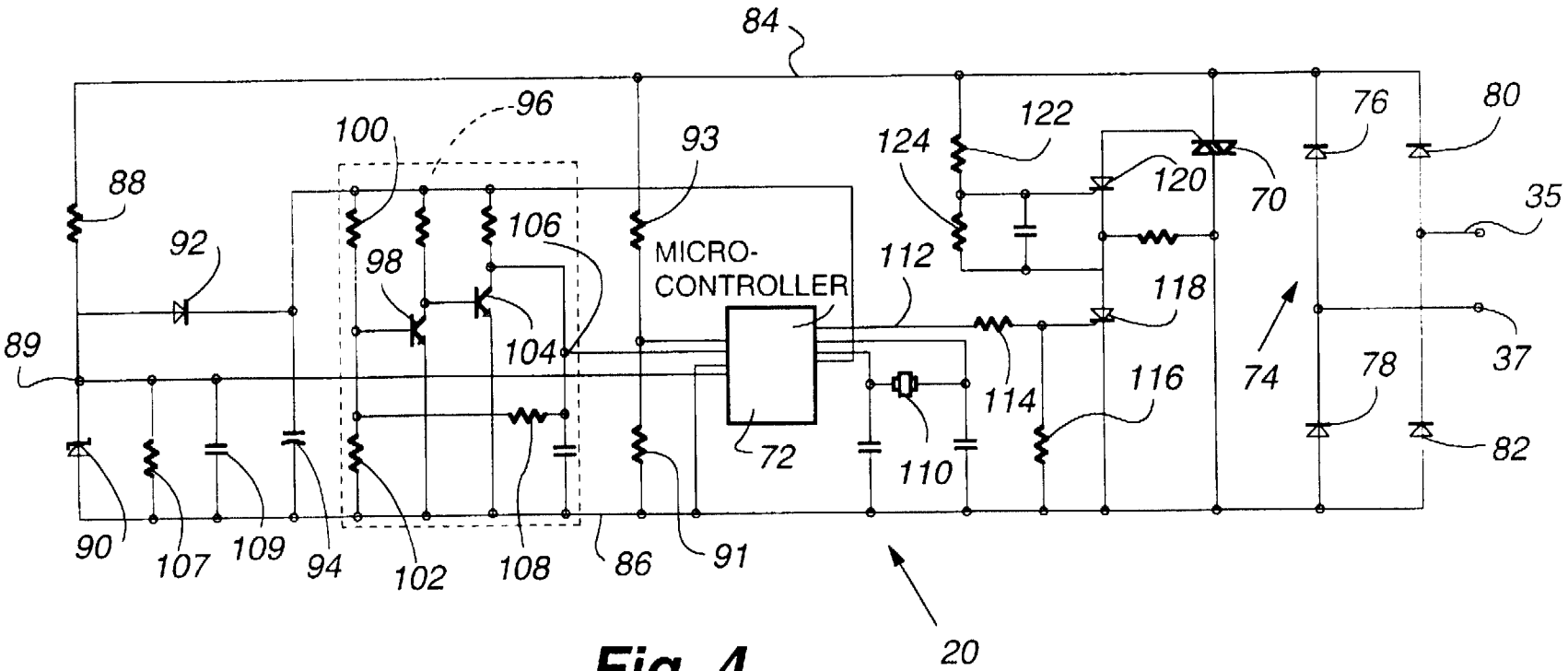
FIG. 4 is a schematic and block diagram of an embodiment of the control module shown in FIG. 1.

Details of one example of the control module 20 are described in conjunction with FIG. 4. Other examples of the control module 20 are described in the above-identified U.S. patent applications. The control module 20 includes a full wave rectifying bridge 74 formed by diodes 76, 78, 80 and 82. The bridge 74 rectifies both the positive and negative half-cycles of applied AC power and applies positive potential at node 84 and negative potential at node 86. The thyristor 70 is connected between the nodes 84 and 86, and as such, the conduction of the thyristor will create the desired effect during both the positive and negative half-cycles of the AC power applied on the cathodes of the fluorescent lamp.

DC power for the microcontroller 72 is supplied by a power supply which is formed by a resistor 88 connected to the diode bridge 74, a voltage-regulating Zener diode 90, a blocking diode 92 and a storage capacitor 94. The storage capacitor 94 charges through the diode 92 to approximately the breakdown level of the Zener diode 90. The Zener diode establishes the voltage level of the power supply. During power interruptions and zero crossings of the applied power voltage, the blocking diode 92 prevents the storage capacitor 94 from discharging. The storage capacitor 94 holds sufficient charge to maintain the microcontroller in a powered-up operative condition during the PIDs and during the times of zero crossings of the applied AC power.

A reset circuit 96 is connected to the storage capacitor 94 for the purpose of disabling the microcontroller 72 and resetting the microcontroller. The microcontroller is disabled until the power supply voltage across the storage capacitor 94 reaches the proper level to sustain reliable operation of the microcontroller 72. The microcontroller is reset when the power supply voltage across the storage capacitor 94 drops below that level which sustains reliable operation of the microcontroller.

The reset circuit 96 includes a transistor 98 which has its base terminal connected to a voltage divider formed by resistors 100 and 102. Until the power supply voltage across the storage capacitor 94 reaches a desired level, the voltage across the resistor 102 keeps the transistor biased into a non-conductive condition. When transistor 98 is non-conductive, a transistor 104 is also conductive, since the base of transistor 104 is forward biased by essentially any level of voltage from the power supply greater than its forward bias voltage. With the transistor 104 is forward biased, the voltage at node 106 is low. A reset terminal of the microcontroller 72 is connected to the node 106 and, while the voltage at the reset terminal is low, the microcontroller 72 is held in a reset or non-operative state.

As the voltage across the power supply storage capacitor 94 increases, the voltage on the base of transistor 98 increases and eventually reaches the point where the transistor 98 starts to conduct. The conducting transistor 98 decreases the voltage at the base of transistor 104, causing transistor 104 to reduce its conduction. The voltage at node 106 starts to rise, and this increasing voltage is applied by a feedback resistor 108 to the base of transistor 98. The signal from the resistor 108 is essentially a positive feedback signal to accentuate the effect of the increasing conductivity of the transistor 98. The positive feedback causes an almost instantaneous change in the conductivity characteristics of the transistors 98 and 104, resulting in an almost instantaneous jump in the voltage level at node 106. Consequently, the reset signal rapidly and cleanly transitions between a low and high level to establish an operation condition for the microcontroller. A similarly acting but opposite situation occurs to establish a reset condition when the voltage from the power supply capacitor 94 diminishes below the operating level due to the positive feedback obtained from the resistor 108.

A filter is formed by a resistor 107 and a capacitor 109, and this filter is connected across the Zener diode 90 between a node 89 and the node 86. The microcontroller 72 includes an input terminal connected to the node 89 for the purpose of detecting zero crossings of the applied AC voltage signal. The resistor 107 and capacitor 109 eliminate any spurious signal effects which would otherwise inhibit the detection of the zero crossing event. The microcontroller 72 senses interruptions in the supplied AC power using the voltage divider formed by resistors 91 and 93 connected to nodes 84 and 86. The resistors 91 and 93 are selected to reduce the peak-peak AC voltage from the source 28 (FIG. 1) to a magnitude that is appropriate for sensing by the microcontroller 72.

A regulated frequency reference for the clock frequency of the microcontroller 72 is established by a crystal 110 connected to two of the terminals of the microcontroller 72.

A signal for firing or triggering the thyristor 70 into a conductive condition is generated by the microcontroller at 112. The signal 112 is conducted through resistors 114 and 116 and the signal developed across resistor 116 is applied to the gate of a first pilot silicon controlled rectifier (SCR) 118. A second pilot SCR 120 is connected in series with the first SCR 118, and the series connection of the two pilot SCRs 118 and 120 extends between the gate of the thyristor 70 and the node 86. The conduction of SCR 118 causes a voltage to develop across the series connected resistors 122 and 124, because resistor 124 becomes connected through the conducting SCR 118 to the node 86. The voltage developed across the resistor 124 triggers the gate of the thyristor 70 and triggers it into conduction. As a practical matter, the conductivity effects of the two pilot SCRs occurs so quickly that both become conductive essentially simultaneously, as does the thyristor 70.

Two pilot SCRs 118 and 120 are used to obtain a greater breakdown voltage. A high breakdown voltage is important to withstand the high voltage ignition pulses which occur during starting of the fluorescent lamp. A single pilot device could be employed in place of the two pilot SCRs 118 and 120 if the single device had a sufficiently high breakdown voltage. Furthermore, the two pilot SCRs 118 and 120, or a single SCR with a high breakdown voltage, could be fabricated on the same substrate as the thyristor 70, thereby achieving a single semiconductor device which accomplishes the functions of the discrete devices 70, 118 and 120, as shown in FIG. 4.

The thyristor 70 has a relatively high holding current, as explained in the aforementioned applications. Briefly, the holding current is that amount of current which the thyristor must conduct through its power terminals to maintain its conductive condition after it has been triggered. If the current falls below the holding current for any reason, the thyristor will immediately cease conduction. A thyristor with a variable holding current characteristic that has proved advantageous, and which allows the holding current value to be adjusted, is part number TN22 manufactured by SGS-Thompson Microelectronics.

The high holding current characteristic of the thyristor 70 is advantageously used to reliably start or ignite the fluorescent lamp. The role of the holding current in establishing the ignition pulses is summarized briefly here, as well as in many of the above-identified U.S. patent applications, in order to understand the interaction of the starting aspects and dimming aspects of the control module.

When the current conducted by thyristor 70 approaches zero near the end of the half-cycle of current conduction shown in FIGS. 2B, 3B, the holding current level of the thyristor 70 is reached. FIG. 5 shows at 56 the current conducted at the end of the half-cycle illustrated in FIG. 3B, and the holding current level is shown at 132. As soon as the conducted current 56 reaches the holding current level 132, which occurs at 133, the thyristor 70 ceases conducting and commutates off. At this commutation point 133, the current flowing through the ballast 26 (FIG. 1) is equal to the holding current 132. Due to the relatively high holding current level 132, the commutation of the thyristor 70 creates a relatively large change in current per change in time (di/dt). The inductive character of the ballast 26 responds to the high di/dt and causes a large voltage spike or ignition pulse 134 to occur, as shown in FIG. 5. The pulse 134 is applied across the cathodes 36 (FIG. 1) of the lamp 24, and the pulse 134 is sufficiently large to ignite the plasma and light the lamp. By way of example, an ignition voltage pulse 134 with a magnitude of 800 volts will occur for about 10 microseconds from a typical fluorescent ballast with a holding current of about 100 milliamperes.

The inductance of the ballast causes an approximate 90° phase shift between the current flowing through the ballast and the AC voltage across the cathodes. This phase shift ensures that the ignition voltage pulse 134 occurs at a time when the AC voltage across the lamp cathodes 36 (FIG. 1) is near the peak value of the phase shifted half-cycle of applied AC voltage. At this point the applied AC voltage exceeds the operating voltage 40 of the fluorescent lamp. Consequently, the high voltage ignition pulse 134 occurs when the pulse and applied voltage conditions are the most likely to start the fluorescent lamp. Very high reliability in igniting the lamp is achieved. It is due to this high ignition reliability that it is possible to achieve dimming or intensity control.

Following ignition of the lamp, the microcontroller 72 delivers a trigger signal 112 to gate the thyristor 70 into a conductive condition and to extinguish the lamp at a predetermined point within that same voltage half-cycle. The predetermined point during the half-cycle at which the thyristor is gated on is commonly referred to as the "firing angle." The firing angle is selectable and variable as represented by the points 52 and 54 in FIG. 3A. The predetermined points 52 and 54 are measured with respect to the zero crossing point of the applied AC voltage. During steady state conditions the predetermined points do not change in time duration measured from the zero crossing point.

The predetermined firing angle points establish the level of intensity of the lamp. Since the lamp is lighted between the beginning of the applied AC half-cycle until the thyristor 70 is fired into the conductive state, the amount of illumination from the lamp is represented by the conduction time between the beginning of the applied half-cycle and the extinguishing or firing angle point. Maximum illumination occurs when the entire half-cycle is applied to the lamp. Diminishing amounts of illumination occur when as the extinguishing point moves closer to the zero crossing point at the beginning of the half-cycle.

Because the thyristor 70 has been gated on to a conductive condition before the end of the applied AC half-cycle, it is in a conductive condition to be commutated off at point 133 when the applied AC current 56 reaches the holding current level 132, as shown in FIG. 5. Gating the thyristor into a conductive state during the half-cycle to control the illumination intensity also ensures that an ignition pulse 134 will occur to ignite the lamp at the beginning of the following half-cycle. The predetermined point during each applied voltage half-cycle when the thyristor 70 is gated on may be varied by the user to provide for different dimming or illumination intensities of the fluorescent lamp.

During the time when the thyristor is conductive and the fluorescent lamp is extinguished, current is drawn through the lamp cathodes, as shown by the current waveforms in FIGS. 2B, 3B and 4B. This current advantageously heats the cathodes, thereby maintaining them in a state of readiness for the next high voltage ignition pulse 134. The heated cathodes ensure that the lamp will be re-lighted on the following half-cycle. Additionally, maintaining the cathode temperature during the periods when the lamp is extinguished tends to extend the life of the cathodes by preserving a barium coating typically placed on fluorescent lamp cathodes. The barium coating promotes electron emissions during operation of the lamp and tends to evaporate during normal or full intensity operation of a fluorescent lamp. However, the barium coating degrades much more quickly when the lamp is relighted with cooled cathodes. Thus, heating the cathodes while the lamp is extinguished both prolongs the life of the lamp and helps to ensure that the lamp will be successfully restarted on each voltage half-cycle.

With reference to this information, which is also described in greater detail in the above-mentioned U.S.

patent applications, the details of the present invention can be more clearly appreciated.

The dimming controller 31 controls the intensity level of the fluorescent lamp 24 by sending control signals to the microcontroller 72 in the control module 20. Preferably the control signals are short power interruptions, and the power interruptions are sent over the power supply conductors of the fluorescent lamp circuit 22. The power interruptions are sensed by the microcontroller 72 as power interruption detections (PIDs). The sequence, pattern and duration of the PIDs are correlated to the programmed information in the microcontroller 72 to control the operation of the control module 20, by causing the microcontroller to adjust the firing angle-extinguishing point and establish the different illumination intensity levels in response to the PIDs.

A precise and familiar type of intensity control is obtained by using the dimming controller 31. Typically the dimming controller 31 is mounted for use in the manner typical of a conventional switch. The dimming controller also includes a microcontroller, microprocessor, state machine or other logic circuit engine which delivers the PIDs with precise, predetermined characteristics.

Figure 6:
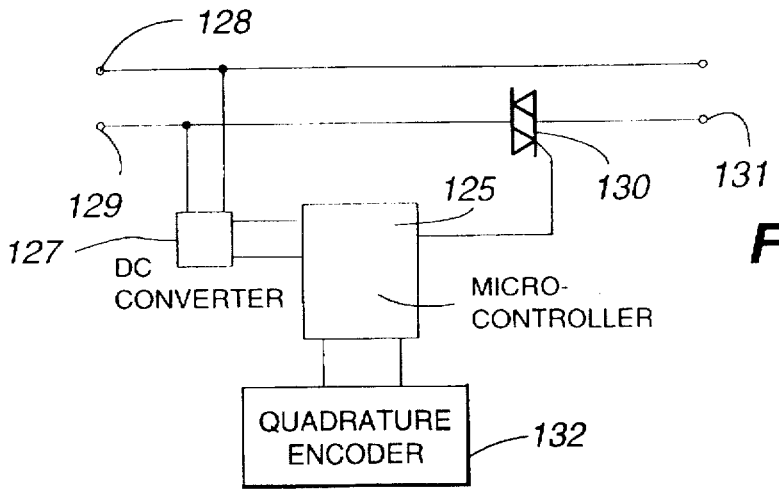
FIG. 6 is a schematic and block diagram of the dimming controller shown in FIG. 1.

Details of one embodiment of the dimming controller 31 are shown in FIG. 6. The dimming controller 31 includes a microcontroller 125 that is powered by a DC converter 127. The converter 127 derives power from nodes 128 and 129, which constitute the power supply conductors from the AC power source 28, as shown in FIG. 1. A thyristor 130 is connected between the node 129 and a terminal 131. Terminal 131 is connected to the power supply conductors of the lamp circuit 22, as shown in FIG. 1. The dimming controller 31 is therefore connected to the conventional power supply conductors in the lamp circuit 22 at nodes or terminals 128, 129 and 131.

The thyristor 130 is controlled by the microcontroller 125 to achieve a conductive state and a non-conductive state. In the conductive state, the thyristor 130 conducts current from the AC power source through terminals 128 and 131 to the remainder up the fluorescent lamp circuit 22 (FIG. 1). In the non-conductive state, the power flow to the fluorescent lamp circuit 22 is interrupted.

A conventional quadrature controller 132 is connected to the microcontroller 125. A conventional manual control knob or other mechanical actuator (not shown) is part of the quadrature controller 132. Manipulation of the control knob or actuator sends signals to the microcontroller 125 to achieve increases and decreases in the illumination intensity from the fluorescent lamp.

The signals delivered from the quadrature controller 132 to the microcontroller 125 are the conventional signals delivered by a quadrature controller. To signal an increase in value, the quadrature controller delivers a signal on one of the conductors connected to the microcontroller which exhibits a positive phase shift with respect to the signal on the other conductor. To signal a decrease in value, the relative phase shift of the signals delivered to the microcontroller is negative. The signals delivered are one or more pulses. The number of pulses is directly related to the extent of movement of the control knob or the actuator. Thus, movement of the control knob or actuator in one direction signifies an increase or decrease in value by an amount related to the number of pulses delivered and the relative phase relationship of the pulses.

The microcontroller 125 includes at least one conventional register (not shown) which counts and records the number of pulses delivered by the quadrature controller 132, as well as signifying whether the pulses represent an increase or a decrease. The count value in the register is employed to determine whether the desired increase or decrease in illumination intensity is achieved.

The microcontroller 125 correlates the signals from the quadrature controller 32 to a desire by the user to increase or decrease in the illumination intensity of the fluorescent lamp. In response, the microcontroller 125 generates PIDs by controlling the thyristor 130 to momentarily interrupt the AC power supplied through the terminals 129 and 131. As discussed below, the occurrence and time duration of the PIDs generated by the dimming controller 31 constitute control signals for the control module 20 (FIG. 1) to adjust the illumination intensity of the fluorescent lamp 24.

Three types of PIDs are delivered by the microcontroller 125. One type of PID is interpreted by the microcontroller 72 of the control module 20 to ramp up or continually increase the illumination intensity of the lamp, by moving the firing angle-extinguishing point closer to the end of each applied AC half-cycle. In the preferred embodiment, this illumination-increasing type of PID has a time duration of 3 complete AC cycles of current supplied by the power supply 28 (FIG. 1). Another type of PID is interpreted by the microcontroller 72 to ramp down or continually decrease the illumination intensity of the lamp, by moving the firing angle-extinguishing point closer to the beginning of each applied AC half-cycle. In the preferred embodiment, this illumination-decreasing type of PID has a time duration of 4 complete AC cycles. The third type of PID is one which signals the microcontroller 72 to cease ramping up or cease ramping down. The third type of PID is thus delivered to cease the action initiated by one of the first two types of PIDs. In the preferred embodiment, this cease-change type of PID has a time duration of between 5 or 6 complete AC cycles.

The count value in the register of the microcontroller 125 derived from the number and phase relationship of the signals supplied by the quadrature controller is employed to determine when the cease-change type of PID is delivered. The program of the microcontroller 125 of the dimming controller 31 interacts with the program of the microcontroller 72 of the control module 20 to change the firing angle-extinguishing point at a predetermined rate. An example of the rate at which the control module changes the firing angle-extinguishing point is at a rate of 1 degree per each to complete AC cycles of applied power, although any other convenient rate could be employed. The count value recorded in the register of the microcontroller 125, which represents the amount of increase or decrease desired, can therefore be directly correlated to the amount of time which the control module 20 will require to execute the change in intensity. Once that amount of time has expired, the microcontroller 125 of the dimming controller 31 delivers the cease-change PID.

Only one illumination-increasing PID or only one illumination-decreasing PID is sent to cause an increase or decrease, respectively, in the illumination intensity. In response to the single illumination-increasing or illumination-decreasing PID, the microcontroller 72 of the control module 20 starts increasing or decreasing, respectively, the illumination intensity at the predetermined rate. The increased or decrease in illumination intensity continues until the cease-change PID is delivered to the control module by the dimming controller. In response to the receipt of the cease-change PID, the control module maintains the level of illumination from the lamp at the level represented by the position of the firing angle-extinguishing point which existed when the cease-change PID was received.

It is necessary to maintain synchronism between expected illumination intensity and the actual illumination intensity in order for the count value recorded in the register of the dimming controller microcontroller 125 to correlate with the actual illumination intensity of the lamp. To maintain synchronization in this regard, the control module microcontroller 72 will, at certain intervals or in response to certain conditions such as a complete ignition sequence, establish a maximum illumination intensity of the lamp. In response, the user will be required to decrease the illumination intensity by manipulating the quadrature controller 132 to create a determined count value in the register of the microcontroller 125, thereby synchronizing the value in the register with the actual illumination level. Alternatively, the value in the register of the microcontroller 125 established by the quadrature controller 132 may be erased after the cease-change PID is delivered. Thereafter, any new value selected by the user will be used as a relative value to increase or decrease the illumination level from that level which then exists.

The technique of delivering a single PID to initiate the increase or decrease in illumination intensity, and hereafter to deliver another single PID to cease any further change in the illumination intensity is particularly important in controlling a fluorescent lamp. Each PID requires the lamp to be re-ignited, requiring that a sequence of steps be executed to ignite the lamp in response to the power interruption, as is more specifically described in the above-identified applications. In contrast, continually delivering momentary power interruptions to control the illumination of the lamp would require that the lamp is continually re-ignited, and would result in flickering of the lamp, thereby making adjustments in intensity difficult to select.

The details of the program flow in accomplishing the control functions over the fluorescent lamp by communicating and decoding the PIDs is more completely understood by reference to the flow charts shown in FIGS. 7A, 7B, 8A, 8B and 9.

Figure 8B:
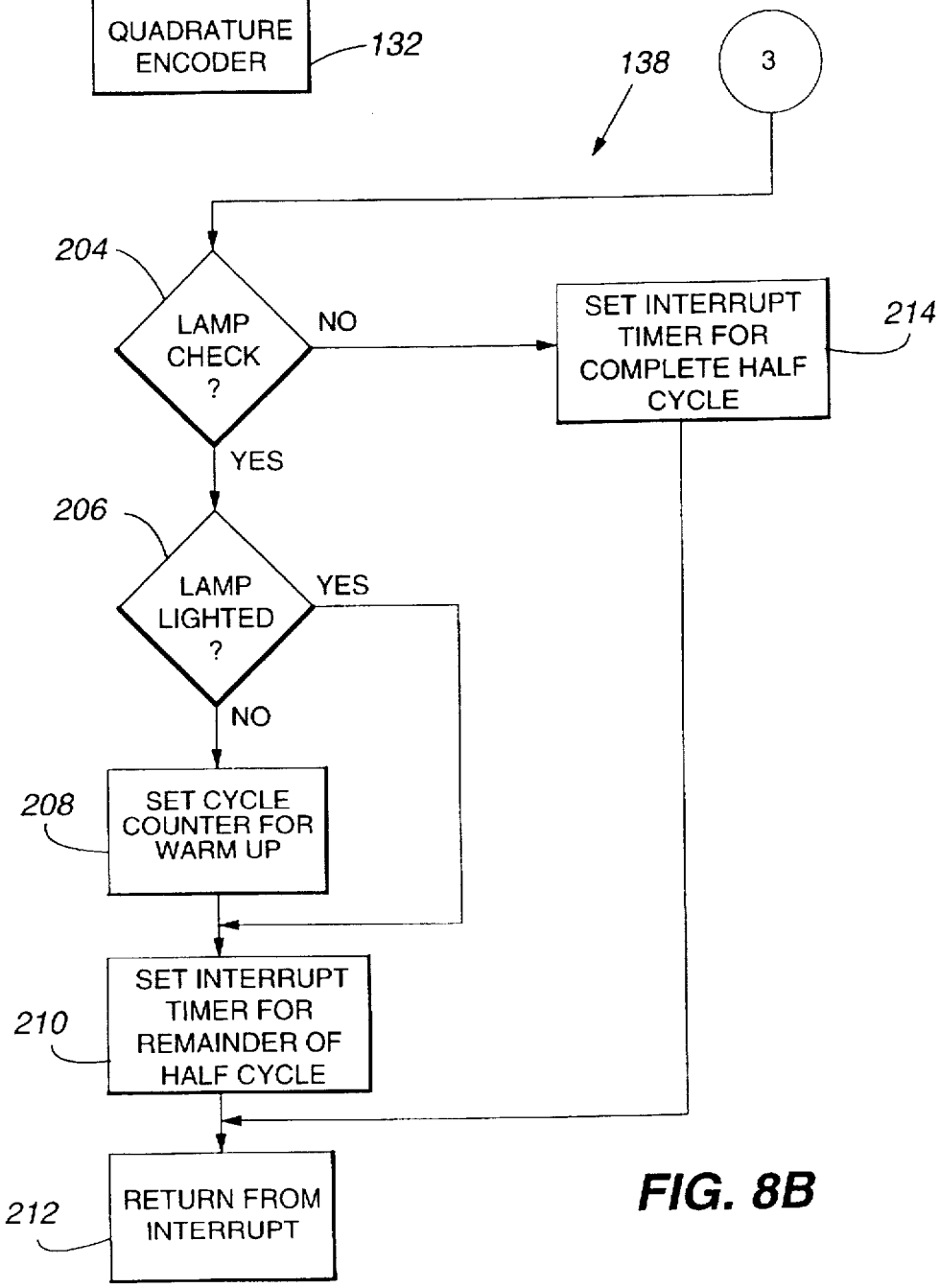
FIGS. 8A and 8B form a single flow chart illustrating the interrupt processing functions shown in FIGS. 7A and 7B.
Figure 7A:
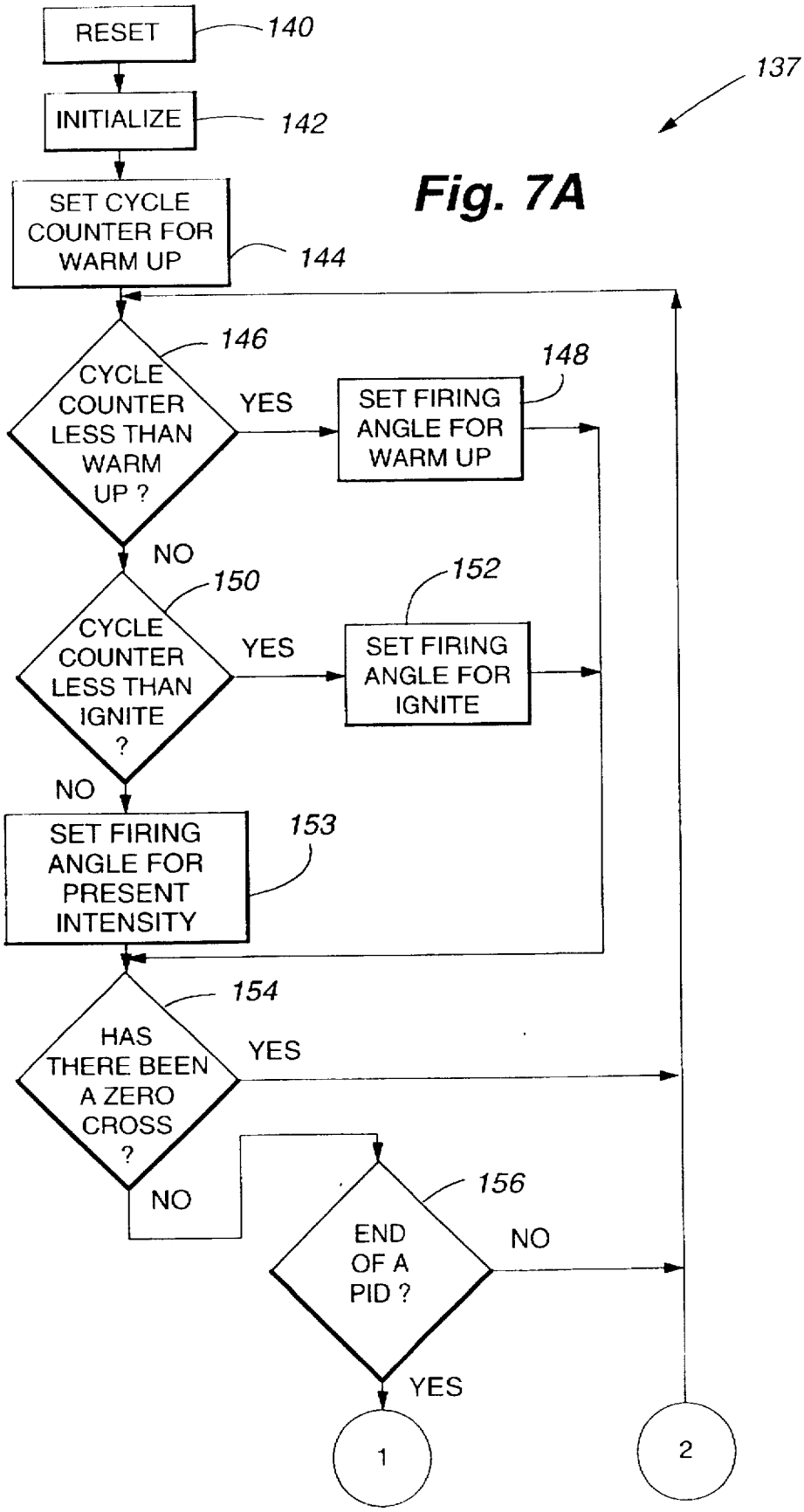
FIGS. 7A and 7B form a single flow chart illustrating the main processing functions of the control module shown in FIG. 1.
Figure 7B:
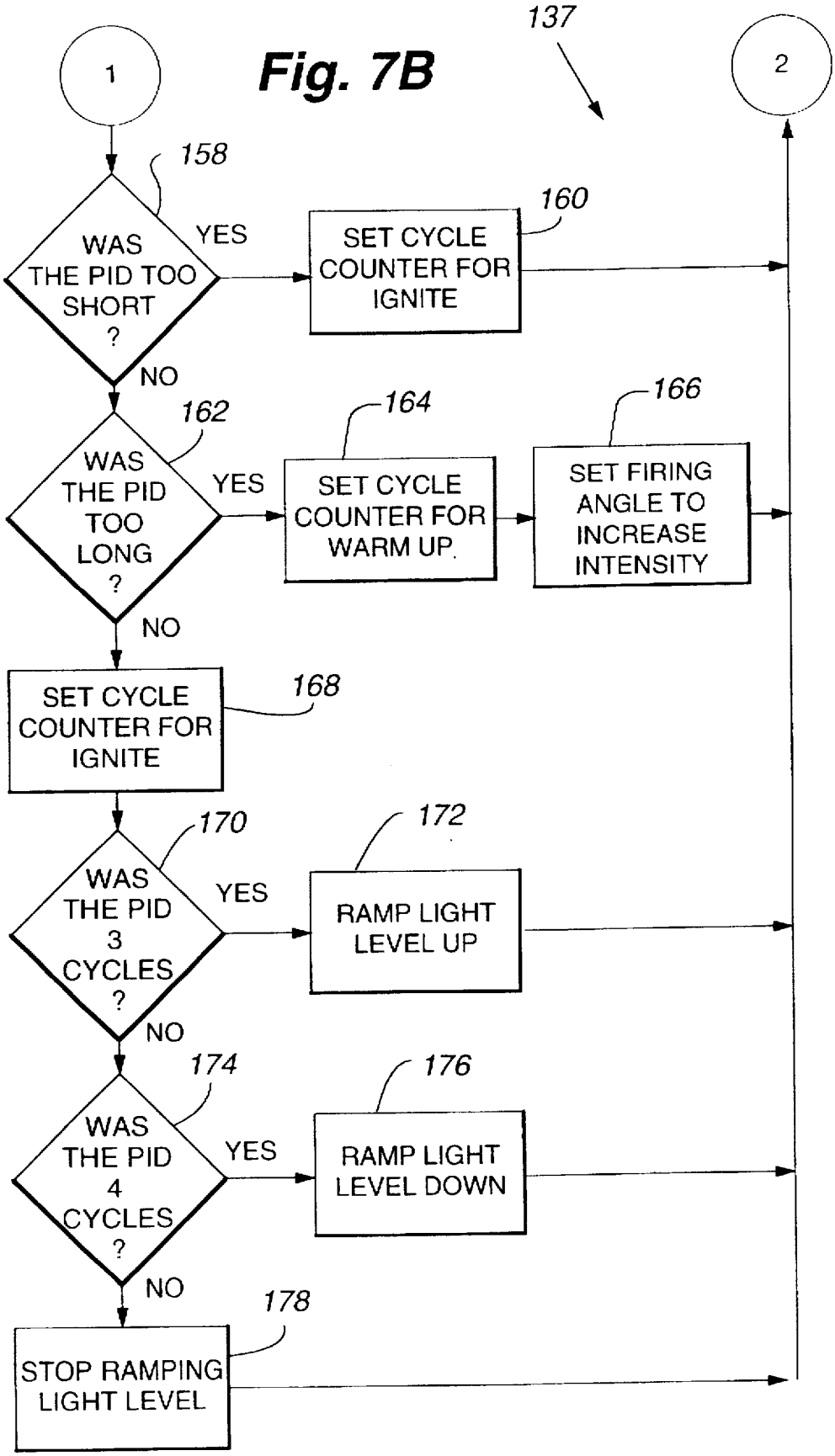
Figure 8A:
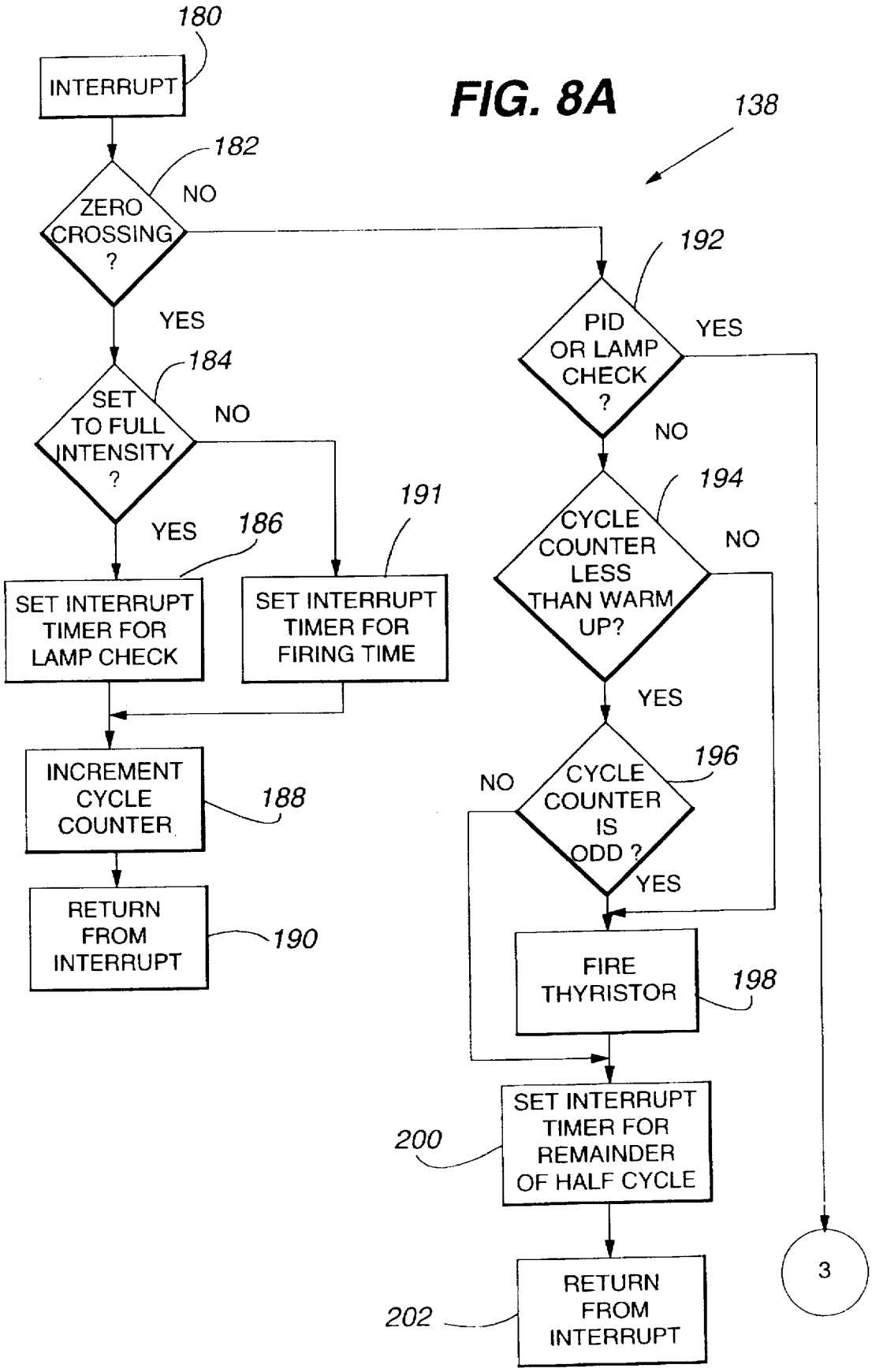

The continuous main operations or processing loop 137 of the microcontroller 72 in the control module 20 is shown by the flow chart shown in FIGS. 7A and 7B. An interrupt loop 138 which may occur at any point within the main processing loop 137 is shown in FIGS. 8A and 8B. The interrupts result from either a zero crossing of the AC voltage between half-cycles of applied power or the expiration of an internal timer of the microcontroller. When the microcontroller leaves the main loop 137 to service an interrupt, the current status of the main loop is saved in registers so that no data is lost and so that upon return from the interrupt loop 138, the microcontroller restores all the main loop registers and proceeds where the processing left off when the interrupt was serviced.

The main loop 137 begins as shown in FIG. 7A, by resetting all the onboard timers at 140 and then initializing all the registers and memory locations within the microcontroller at 142. Next, a cycle counter is set at 144 to keep track of a warm-up period and an ignition period. The cycle counter is incremented once for each applied AC voltage cycle.

The warm-up and ignition periods are used to start or ignite the fluorescent lamp, since the control module 20 is used for that purpose in addition to controlling the intensity of the fluorescent lamp. It is necessary to start or ignite the lamp when AC power is initially applied or to reignite the lamp following a temporary interruption of AC power. To start the fluorescent lamp under these conditions, the lamp cathodes are preheated during the warm-up period to vaporize the mercury within the lamp housing. Thereafter the lamp is ignited by delivering the ignition pulses during an ignition time period. After igniting the lamp, the intensity is adjusted.

Preheating the cathodes causes electrons to be emitted to create an ionized environment within the lamp housing. Due to the preheating the ignition pulses are more likely to ignite the ionized mercury into the plasma. During the warm-up period, the high voltage ignition pulses are delivered only during every other AC half-cycle (as described more fully in the '007 Application and as illustrated in FIG. 8A below). The typical warm-up period is less than 0.5 seconds.

During the ignition period which follows the warm-up period, the high voltage ignition pulses are applied during each half-cycle. The firing angle is set initially to establish the lowest illumination intensity. The firing angle for the lowest illumination intensity level maximizes the amount of cathode current to continue heating the cathodes. The heated cathodes maximize the opportunity for the ignition pulses to light the lamp. The ignition period may be timed to last for about five complete AC cycles or ten AC half-cycles, for example.

To keep track of the timing for the warm-up and ignition periods, a first determination is made at 146 as to whether the cycle counter presently contains a cycle count value which is less than the predetermined warm-up count value. For example 30 cycles occur during a 0.5 second warm-up period, when the applied AC power is 60 Hz. If the cycle count is less than the warm-up count, as determined at 146, the firing angle of the thyristor is adjusted at 148 to maximize the current through the lamp cathodes. As noted above, the firing angle which results in maximum cathode current is equivalent to operating the lamp in the dimmest setting.

If the determination at 146 is that the cycle counter count value exceeds the predetermined warm-up count value, meaning that the warm-up period has elapsed, a determination is made at 150 whether the cycle counter is less than a predetermined ignition cycle count. As discussed above, following the warm-up period, the control module will attempt to light the fluorescent lamp for five complete AC cycles immediately following the warm-up period, for example. Thus, once the warm-up period has expired and the ignition period begins, the firing angle is set at the preferred ignition intensity, as shown at 152, to maximize the starting potential for the fluorescent lamp. In general, the preferred ignition firing angle is substantially equivalent to operating the lamp at a fifty percent illumination intensity. The fifty percent illumination intensity balances the cathode heating effect of the current and the maximum voltage effect for sustaining the ignited plasma.

If the determinations at 146 and 150 are both negative meaning that both the warm-up and the ignition periods have expired, meaning that the lamp should be operating in its normal state, the firing angle is set to achieve the user-requested illumination intensity, as shown at 153.

Once an appropriate firing angle has been set at 148, 152 or 153, a further determination is made at 154 as to whether a zero crossing of the applied AC waveform has occurred. The determination of a voltage zero crossing is one of the interrupt conditions which causes the program flow to move to the interrupt loop 138 shown in FIGS. 8A and 8B. If the determination at 154 is that there has been a voltage zero crossing, the status quo is maintained and the program flow reverts to the beginning of the main loop 137 at the determination at 146 and the cycle counter is incremented within the interrupt loop as described below.

If the determination at 154 is that there has not been a zero crossing, an additional determination is made at 156 whether the end of a PID has occurred. PIDs of different lengths are interpreted as signals to change the intensity or dimming level of the fluorescent lamp. If the determination at 156 is that a PID has not ended, the program flow loops back to the beginning of the main loop 137 at the determination at 146. Determining the end of a PID in this manner allows the full length of the PID to the established before action is taken based on that PID.

When the end of a PID is determined at 156, the length of the PID is checked at 158 and 162, as shown in FIG. 7B. Relatively long PIDs indicate that a user is manually changing the light intensity by not using the dimming controller 31 (FIG. 1), such as by flipping on and off a light switch (not shown) connected in the power supply conductors. Relatively short PIDs may be spurious and momentary power outages or "glitches." Those PIDs which are true control signals and those PIDs which are too short or too long to be valid control signals are detected and discriminated.

A first determination is made at 158 whether the PID is "too short." The length of time for a PID which is too short is established in relation to a desired degree of separation between PIDs which are valid control signals and momentary spurious power interruptions. For example, a PID which is "too short" may be less than three AC cycles. If the determination at 158 reveals that the PID is too short, the half cycle counter is set for the ignition time period at 160, and the program flow loops back to the beginning of the main program 137 at the determination at 146 (FIG. 7A).

Although the half cycle counter is set for the ignition time period, the firing angle for the selected intensity level is not changed. These conditions are established because the too-short PID may have extinguished the lamp, and entering the ignition period immediately allows the lamp to be restarted and then revert to the desired intensity setting. Due to the short duration of the "too short" PID determined at 158, no additional preheating of the cathodes 36 is required, which is why the counter is set for the ignition period rather than the warm-up period.

If the PID is determined not to be "too short" at 158, a determination is next made at 162 to see if the PID is "too long." A PID which is "too long" is a power interruption of time duration greater than would be delivered by the dimming controller 31 for controlling the control module 20. For example, a PID which is "too long" is one which is seven or more cycles. A PID which is "too long" is interpreted as a desire to terminate the operation of the lamp altogether.

Under termination of operation conditions, it is assumed that a cold start will be required, and the cycle counter is then set for the warm-up period at 164. The warm-up period is selected on the assumption that the cathodes 36 have cooled to a degree which will require warming before an attempt is made to re-ignite the lamp. Thereafter, the firing angle which controls the light intensity is adjusted at 166 to the next higher level of intensity within a predetermined series of intensity steps, such as low, medium and high intensity. Adjusting the intensely level upward at step 166 assists in relighting the lamp, and allows the user to reduce the intensity once the lamp is lighted. Increasing the light intensity reduces the amount of the cathode heating in the lamp, while decreasing the light intensity increases the amount of cathode heating.

Next, if it is determined at 162 that the PID was not "too long," the assumption is that the PID was delivered by the dimming controller 31 for control purposes, and the cycle counter is set to the ignition time period at the step 168.

A determination is next made at 170 whether the PID was three cycles. In response to a 3 cycle PID, the firing angle is increased to start ramping up the illumination intensity at 172. The light level is increased by only a relatively small predetermined amount with each pass through the main loop 137. The small incremental increases allow for very fine adjustments in light intensity. However, since the flow through the main loop 137 is accomplished quickly, for example in the time of one AC half-cycle, the larger increases in intensity are quickly accomplished.

Alternatively, if the determination at 170 is that the PID was not three cycles, a further determination is made at 174 as to whether the PID was four cycles long. If the PID was four cycles long, the firing angle is decreased to ramp the light level down at step 176. The light level is decreased at 176 by only a relatively small predetermined amount with each cycle through the main loop 137. Because the flow through the entire loop is accomplished quickly, the decrease in intensity is quickly accomplished.

After the light intensity has either ramped up or down at 172 or 176, respectively, the program flow loops back to the beginning of the main loop 137 at the determination at 146.

On the other hand, if the determination at 174 is that the PID was not four cycles in length, then, because of the previous determinations at 158, 162 and 170, the PID length must fall within the range of 5 or 6 cycles, when, for example, a "too-long" PID 9 (which is interpreted as a termination in operation) is one that is 7 or more cycles. A PID length of 5 or 6 cycles is interpreted as a stop control signal which halts the ramping of the lamp intensity either up or down at step 178. The delivery of the appropriate length PID to stop the ramping of the light intensity indicates that the user is satisfied with the intensity and further changes in the lamp intensity should cease.

When an interrupt occurs during execution of the functions in the main loop 137, the program flow moves from the main loop to service the interrupt loop 138 shown in FIGS. 8A and 8B. An interrupt 180 may occur at any time during execution of the main loop 137. However, only two occurrences can trigger the interrupt 180: a zero crossing of the applied AC voltage waveform, and the expiration of a timer on board the microcontroller 72. Onboard timers are conventional in microcontrollers. In the control module 20, the onboard timer is used to adjust the firing angle for illumination intensity control purposes, and to determine if a voltage zero crossing was missed, and to determine when to perform a lamp check operation described below.

Upon the occurrence of an interrupt as shown at 180 in FIG. 8A, a determination is made at 182 whether the interrupt was caused by the zero crossing of the applied AC voltage. If so, a second determination is made at 184 whether the lamp is set for full intensity. Under full intensity conditions, the control module does not become conductive prior to the end of the AC half-cycle. Under the full intensity operating condition at this point in the program flow, the microcontroller sets an onboard timer for a lamp check at 186.

A lamp check is performed by the microcontroller approximately at the midpoint of each applied AC half-cycle. The purpose of the lamp check is to determine if the lamp is ignited or extinguished. If extinguished, the lamp needs to be re-ignited. The timer which is set at 186 times out at a point about midway through the applied AC voltage half-cycle. At this midway half-cycle point, the maximum peak of the AC voltage is applied to the cathodes under full intensity conditions. A measured voltage across the lamp cathodes which exceeds the ignition voltage level (approximately 125 volts as noted above) at the peak of the AC line voltage is an indication that the lamp is extinguished and needs to be re-ignited. If the lamp was lighted at the lamp check time, the voltage across the lamp cathodes would be only at the ignition voltage level, not the higher level of the impressed AC voltage (approximately 177 volts for a 120 volts RMS AC power). The full intensity determination at 184 as a condition to the execution of a lamp check assures that the lamp check will occur under operating conditions which will reliably show whether or not the lamp has extinguished.

If the lamp is not set to full intensity as determined at 184, an interrupt timer is set at 191 to gate or fire the thyristor at the predetermined time during the half-cycle for the desired firing angle-extinguishing point which results in the desired light intensity or level from the lamp. Continuing operation of the lamp at the intensity setting which existed prior to the interrupt is thereby assured when the program flow reverts back to the main loop 137.

Prior to reverting back to the main loop, the interrupt loop program flow 138 moves from the steps 186 or 191 to increment the cycle counter 188. The condition under which this branch of the interrupt loop 138 is entered is the determination at 182 of a zero crossing. A zero crossing is the indication of the occurrence of another half-cycle, so the cycle counter is incremented at 188 before returning to the main loop at 190. Incrementing the cycle counter which was initially set within the main loop allows the main loop to keep track of the different warm-up and ignition periods at 146 and 150, respectively.

Upon returning to the main loop at 190, the main loop processing continues until another interrupt occurs at a zero crossing or when a timer times out. Thus, under full intensity conditions, the main loop processing is interrupted at two different points during each half-cycle: once at the zero crossing and a second time to check the lamp voltage at the midpoint within the voltage half-cycle to determine if the lamp is still operating.

If the interrupt determined at 182 results from other than from a zero crossing, then the interrupt has resulted from the onboard timer timing out for one of three reasons: a half-cycle zero crossing was missed due to a PID, since each control signal PID extends for more than one complete half-cycle, and preferably for more than three complete cycles; a mid half-cycle lamp check is to be performed; or at the firing angle-extinguishing point occurs for dimming purposes. The determination made at 192 is the whether a PID was caused by a lamp check or a timer timing out after a voltage zero crossing should have been detected. If the determination at 192 is negative, then the interrupt was necessarily caused by the timer timing out at the predetermined firing angle-extinguishing point within the AC voltage half-cycle when the control module becomes conductive to extinguish the lamp for dimming purposes.

In the case of a negative determination at 192, a determination is made at 194 as to whether the cycle counter indicates that program flow is still within the warm-up period. If so, an additional determination is made at 196 whether the cycle count is odd. The determination at 196 is necessary because the high voltage ignition pulse is fired only during every other half-cycle during the warm-up period. If the cycle count is odd, the thyristor is gated on at 198 to short out the lamp filaments and provide warming current to the lamp cathodes. If the cycle count is not odd, as determined at 196, the interrupt timer is reset at 200 for the time remaining in the applied AC voltage half-cycle. Thereafter, the program flow returns to main loop 137 at step 202.

On the other hand, if the warm-up period has expired, as determined at 194, the thyristor is fired at 198 to dim the lamp. After the thyristor is fired at 198, it is important to reset the interrupt timer at 200 for the remainder of the voltage half-cycle before returning to the main loop at 202. Resetting the interrupt timer as shown at 200 allows the microcontroller to determine whether a zero crossing has been missed and thereby allows proper interpretation of PIDs at 192.

If the determination at 192 is that the timer expired due to a PID or a lamp check, a further determination is made at 204 as shown in FIG. 8B as to whether the interrupt was due to a lamp check. If the determination at 204 is that the interrupt resulted from a lamp check timer timing out, a lamp check function is to be performed. The voltage across the lamp cathodes is then checked at 206 to determine if the lamp is ignited or extinguished. If a voltage greater than the lamp ignition voltage is detected at 206, the lamp has been extinguished and the cycle counter is reset at 208 to begin the warm-up period. The interrupt timer is then set at 210 for the remainder of the voltage cycle which, as explained above, is necessary to allow proper determination of PIDs at 192 (FIG. 8A). On the other hand, if the lamp check at 206 determines that the lamp is lighted, the interrupt timer is set for the remainder of the AC half-cycle at 210 before returning to the main loop at 212.

If the determination at 204 is that the interrupt did not result from the expiration of the timer for a lamp check, the interrupt is necessarily a PID resulting from the determination at 192 (FIG. 8A). The length of the PID must be measured. The length of the PID is important in properly setting the intensity level as described above in conjunction with the main loop 137.

Under conditions where the interrupt results from a PID, the interrupt timer is set at 214 to count a complete half-cycle before returning to the main loop at 212. Resetting the timer to count a complete half-cycle is necessary because a PID signifies that a zero crossing has already been missed and each expiration of the timer determines the number of zero crossings which are missed during the PID. The length of the PID in terms of the number of cycles of its duration relates directly to the control action to be taken in response to the PID as described above.

Figure 9:
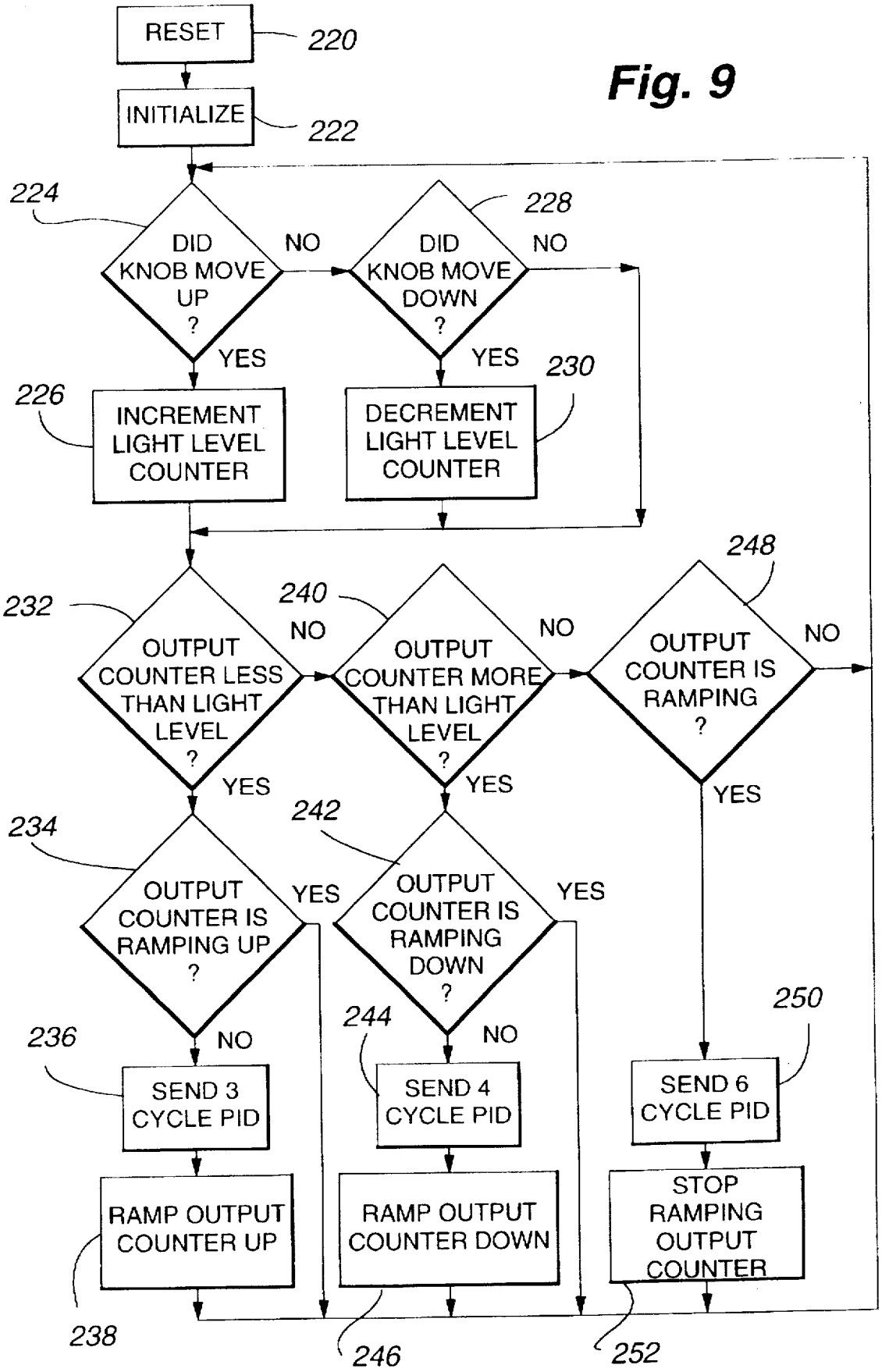
FIG. 9 is a flow chart of illustrating the processing functions of the dimming controller shown in FIG. 6.

The functionality of the main loop 137 and the interrupt loop 138 interacts with the program flow created by the microcontroller 125 of the dimming controller 31 (FIG. 6). The program flow for the microcontroller 125 of the dimming controller is shown in FIG. 9.

The program flow of the dimming controller 31 begins by resetting at 220 and then progresses to initializing the registers and counters internal to the microcontroller at step 222. The initialization step at 222 sets an internal register of the microcontroller 125 with a value which represents the light output of the fluorescent lamp. The value set in this internal counter is used as a reference for future adjustments, in the manner described previously. Alternatively, a conventional photo sensor (not shown) could be incorporated within the dimming controller 31 to sense the illumination intensity of the lamp, provided that only the light from the fluorescent lamp directly impinged on the sensor.

A determination is next made at 224 as to whether the user is moving a control knob of the quadrature controller 132 (FIG. 6) of the dimming controller to signify a desire to increase the light intensity. If so, a light level selection counter is incremented at 226, in the manner previously described. The light level selection counter contains a count value which represents the level of light which the user has selected, relative to the value initialized at 220.

If the control knob was not moved to increase the light intensity as determined at 224, a determination is made at 228 as to whether the control knob of the quadrature controller 132 (FIG. 6) was moved to signify a decrease in illumination intensity. Decreasing the illumination intensity results in decrementing the light level selection counter at 230.

If no movement of the control knob is sensed at either 224 or 228, indicating that no change in the illumination intensity is desired, or after the light level counter is either incremented or decremented at 226 and 230, respectively, the program flow moves to 232. A determination is made at 232 whether the value in the light output counter is less than the value in the light level selection counter. If so, this condition signifies that the fluorescent lamp is presently energized to an intensity level which is lower than that desired by the user. Under these conditions, the light output counter should be ramping up or increasing in value to indicate that the PIDs generated by the dimming controller have had their desired effect. A determination is made at 234 whether the light output counter is currently ramping up. If the light output counter is ramping up, the program flow returns to the beginning at step 224.

If it is determined at 234 that the output counter is not ramping up, which would be the situation immediately after the user requests an increase in light intensity, the dimming controller sends a 3-cycle PID at 236 to the control module 20. The 3 cycle PID is interpreted at 170 in the main loop (FIG. 7B) as a request to ramp the light level up at 172. The dimming controller then senses the increase in current flow and ramps up the output counter at 238. Thereafter the program flow returns to the beginning at step 224.

If the determination at 232 is that the light output counter value is not less than the selected light level counter value, a further determination is made at 240 as to whether the light output counter value is greater than the selected light level counter value. The light output counter will be greater than the selected light level counter when the actual intensity level is higher than the desired intensity level set by manipulating the control knob of the dimming controller. If the light output counter value is greater than the selected light level counter value as determined at 240, a determination is made at 242 whether the light output counter is currently ramping down. If the light output counter is currently ramping down, the program flow returns to the beginning at step 224. However, if the output counter is not ramping down, the dimming controller sends a four cycle PID at 244 to the control module 20. The four-half-cycle PID is interpreted at 174 in the main loop 137 (FIG. 7B) as a request to ramp the light level down at 176. The decrease in current drawn by the fluorescent lamp is sensed and the output counter ramps down at 246. Thereafter the program flow returns to the beginning of the continuously repeating program steps.

If the determination at 240 is that the value of the light output counter is not greater than the value of the light level selection counter, the illumination intensity of the fluorescent lamp matches the level set at the dimming controller 31. Thereafter, a further determination is made at 248 whether the output counter is ramping, either up or down. If the output counter is ramping as determined at 248, the dimming controller sends a six cycle PID at 250 to the control module 20. The 6 cycle PID is determined at 170 and 174 in the main loop 137 (FIG. 7B) as a request to stop ramping the light level at 178. The control module 20 (FIG. 1) then stops the output counter from ramping at 252. The program flow then returns to the start at step 224.

If the determination at 248 is that the output counter is not presently ramping, the illumination level from the fluorescent lamp is at the desired level and no further signals need be sent to the control module 20. The program flow then returns to the start at step 224 to again execute the continuously repeating steps of the program flow shown in FIG. 9.

In this manner, the dimming controller and control module enable an operator to select an illumination intensity for a fluorescent lamp from a broad continuum of illumination intensity levels. A continuous range of dimming between approximately zero percent to ninety-five percent can be achieved in a fluorescent lamp circuit using a conventional ballast without the expense and complexity of an electronic ballast. The dimming capability achieved by the interaction of the dimming controller and the control module are comparable to that achieved with incandescent lamps. Furthermore, the communication technique of sending momentary power interruption control signals over the power supply conductors of a conventional fluorescent lamp circuit avoids the necessity for and cost of separate control conductors and the like. Further still, the use of only one monetary power interruption to initiate an increase or a decrease in the illumination intensity, followed by the delivery of a single monetary power interruption to cease the change, avoids the flickering and other difficulties associated with continually re-igniting the lamp while adjustments in the illumination intensity are performed.

A presently preferred embodiment of the invention and its improvements have been described with a degree of particularity. This description has been made by way of preferred example. It should be understood that the scope of the present invention is defined by the following claims, and should not necessarily be limited by the detailed description of the preferred embodiment set forth above.

The invention claimed is:

1. A control system for use in controlling the illumination intensity of a fluorescent lamp having cathodes and a medium which is energized into a light emitting plasma by electrical energy supplied on power conductors by a source of AC power in alternating half-cycles of AC voltage and AC current and conducted through a lamp circuit which includes a ballast connected to the lamp, the lamp controller comprising:

a dimming controller adapted to be connected to the power conductors at a location remote from the fluorescent lamp and operative to generate a first control signal indicative of a request to increase the illumination intensity of the fluorescent lamp and to generate a second control signal indicative of a request to decrease the illumination intensity of the fluorescent lamp, the dimming controller transmitting the control signals over the same power conductors of the lamp circuit which conduct the electrical energy to energize the medium into light-emitting plasma; and a control module adapted to be connected to the lamp cathodes and to the power conductors at a location remote from the dimming controller and adapted to receive the control signals transmitted from the dimming controller over the power conductors, the control module changing the illumination intensity of the lamp by selectively varying the portion of each half-cycle of applied AC power during which the medium is energized into the plasma, the control module increasing And decreasing the portion of each half cycle during which the medium is energized into the plasma in response to receiving the first and second control signals, respectively.

2. A control system as defined in claim 1 wherein:

the dimming controller generates a third control signal indicative of a request to cease varying the illumination intensity of the fluorescent lamp; and the control module ceases varying the proportion of each half-cycle during which the medium is energized into the plasma in response to receiving the third control signal.

3. A control system for use in controlling the illumination intensity of a fluorescent lamp having cathodes and a medium which is energized into a light-emitting plasma by electrical energy supplied by a source of AC power in alternating half-cycles of AC voltage and AC current and conducted through a lamp circuit which includes a ballast connected to the lamp, the lamp controller comprising:

a dimming controller adapted to be connected in the lamp circuit at a location remote from the fluorescent lamp and operative to generate a first control signal indicative of a request to increase the illumination intensity of the fluorescent lamp and to generate a second control signal indicative of a request to decrease the illumination intensity of the fluorescent lamp, the dimming controller transmitting the control signals over the lamp circuit;

a control module adapted to be connected to the lamp cathodes and to the lamp circuit to receive the control signals transmitted from the dimming controller, the control module changing the illumination intensity of the lamp by selectively varying the portion of each half-cycle of applied AC power during which the medium is energized into the plasma, the control module increasing and decreasing the portion of each half cycle during which the medium is energized into the plasma in response to receiving the first and second control signals, respectively; and the dimming controller receives a selected illumination intensity value indicative of a desired illumination intensity of the lamp, stores a value related to the actual illumination intensity of the lamp, determines any difference between the actual illumination intensity value and the desired illumination intensity value, and generates one of the first control signal or the second control signal in response to the determined difference to regulate the illumination intensity from the lamp.

4. A control system as defined in claim 3 wherein:

the control module varies at a predetermined rate the proportion of the each half-cycle during which the plasma is energized; and the dimming controller changes the actual illumination value stored based on the predetermined rate of which the control module varies the proportion of the half-cycle during which the plasma is energized.

5. A control system as defined in claim 3 wherein:

the dimming controller generates the first control signal when the actual illumination intensity value is less than the desired illumination intensity value.

6. A control system as defined in claim 3 wherein:

the dimming controller generates the second control signal when the actual illumination intensity value exceeds the desired illumination intensity value.

7. A control system as defined in claim 3 wherein:

the dimming controller generates a third control signal indicative of a request to cease varying the illumination intensity of the fluorescent lamp;

the control module ceases changing the proportion of each half-cycle during which the medium is energized into the plasma in response to receiving the third control signal;

the control module varies at a predetermined rate the proportion of the each half-cycle during which the plasma is energized; and the dimming controller generates the third control signal at a predetermined time after one of the first or second control signals is generated, and the predetermined time is determined by reference to the predetermined rate.

8. The lamp controller as defined in claim 7 wherein:

the dimming controller creates momentary interruptions in power delivered in the lamp circuit to the control module of predetermined time durations, the dimming controller generating the first, second and third control signals as momentary power interruptions of a first predetermined time duration, a second predetermined time duration and a third predetermined time duration, respectively, all of such predetermined time durations being different; and the control module senses a momentary interruption, measures the time duration of the momentary interruption in the AC power and decodes the momentary power interruption into one of the first, second or third control signals.

9. A control system for use in controlling the illumination intensity of a fluorescent lamp having cathodes and a medium which is energized into a light-emitting plasma by electrical energy supplied by a source of AC power in alternating half-cycles of AC voltage and AC current and conducted through a lamp circuit which includes a ballast connected to the lamp, the lamp controller comprising:

a dimming controller adapted to be connected in the lamp circuit at a location remote from the fluorescent lamp and operative to generate a first control signal indicative of a request to increase the illumination intensity of the fluorescent lamp and to generate a second control signal indicative of a request to decrease the illumination intensity of the fluorescent lamp, the dimming controller transmitting the control signals over the lamp circuit;

a control module adapted to be connected to the lamp cathodes and to the lamp circuit to receive the control signals transmitted from the dimming controller, the control module changing the illumination intensity of the lamp by selectively varying the portion of each half-cycle of applied AC power during which the medium is energized into the plasma, the control module increasing and decreasing the portion of each half cycle during which the medium is energized into the plasma in response to receiving the first and second control signals, respectively;

the dimming controller creates momentary interruptions in power delivered in the lamp circuit to the control module of predetermined time durations, the dimming controller generating the first and second control signals as momentary power interruptions of a first predetermined time duration and a second predetermined time duration, respectively, all of such predetermined time durations being different;

the dimming controller generates a third control signal indicative of a request to cease varying the illumination intensity of the fluorescent lamp; and the control module senses a momentary interruption, measures the time duration of the momentary interruption in the AC power and decodes the momentary power interruption into one of the first, second or third control signals.

10. A control system for use in controlling the illumination intensity of a fluorescent lamp having cathodes and a medium which is energized into a light-emitting plasma by electrical energy supplied by a source of AC power in alternating half-cycles of AC voltage and AC current and conducted through a lamp circuit which includes a ballast connected to the lamp, the lamp controller comprising:

a dimming controller adapted to be connected in the lamp circuit at a location remote from the fluorescent lamp and operative to generate a first control signal indicative of a request to increase the illumination intensity of the fluorescent lamp and to generate a second control signal indicative of a request to decrease the illumination intensity of the fluorescent lamp, the dimming controller transmitting the control signals over the lamp circuit; and a control module adapted to be connected to the lamp cathodes and to the lamp circuit to receive the control signals transmitted from the dimming controller, the control module changing the illumination intensity of the lamp by selectively varying the portion of each half-cycle of applied AC power during which the medium is energized into the plasma, the control module increasing and decreasing the portion of each half cycle during which the medium is energized into the plasma in response to receiving the first and second control signals, respectively; and wherein said control module comprises:

a current switch device adapted to be connected in series with the cathodes and which selectively conducts current through the cathodes when triggered into a conductive condition and which ceases conducting current when commutated into an non-conductive condition;

the control module triggering the switch device into the conductive condition and commutating the switch device into the non-conductive condition, the control module triggering the switch device into the conductive condition at a predetermined extinguishing point within and prior to the end of each half-cycle of applied power, and the control module commutating the switch device into the non-conductive condition at a predetermined ignition point when the applied AC current reaches a predetermined level near the zero crossing point of each half-cycle of applied AC current;

the predetermined level of the current at the ignition point and the commutation of the switch device to the non-conductive condition creating an ignition pulse of voltage from the ballast of a magnitude sufficient to ignite an illumination plasma between the cathodes;

the conductive condition of the switch device at the predetermined extinguishing point extinguishes the illumination plasma;

the illumination intensity of the lamp is related to the time between the ignition point and the extinguishing point;

the control module operatively responds to the first control signal to move the extinguishing point to a point later in time within each half-cycle of applied AC voltage to continually increase the illumination intensity of the fluorescent lamp; and the control module operatively responds to the second control signal to move the extinguishing point to a point earlier in time within each half-cycle of applied AC voltage to decrease the illumination intensity of the fluorescent lamp.

11. A control system as defined in claim 10 wherein:

the dimming controller includes a controllable switch device connected in the lamp circuit to interrupt momentarily the AC power supplied through the lamp circuit to the control module for a first predetermined time duration, and to interrupt momentarily the AC power supplied through the lamp circuit to the control module for a second predetermined different time duration, the momentary power interruptions of the first and second predetermined time durations constituting the first and second control signals, respectively;

the control module senses momentary interruptions in the supplied AC power and measures the time duration of each power interruption;

the control module responds to a power interruption having a time duration substantially equal to the first time duration by moving the extinguishing point to a point later in time within each half-cycle of applied AC power to increase the illumination intensity of the lamp; and the control module responds to a power interruption having a time duration substantially equal to the second time duration by moving the extinguishing point to a point earlier in time within each half-cycle of applied AC power to decrease the illumination intensity of the fluorescent lamp.

12. A control system as defined in claim 11 wherein:

the control module continuously moves the extinguishing point to a point later in time within each half-cycle in response to the receipt of a first control signal; and the control module continuously moves the extinguishing point to a point earlier in time within each half-cycle in response to the receipt of a second control signal.

13. A control system as defined in claim 12 wherein:

the dimming controller momentarily interrupts the power supplied through the lamp circuit to the control module for a third predetermined time duration, the power interruption of the third predetermined time duration constituting a third control signal; and the control module responds to a power interruption of the third predetermined time duration by stopping the movement of the extinguishing point within the half-cycle at approximately the point that existed when the third control signal was received.

14. A control system for use in controlling the illumination intensity of a fluorescent lamp having cathodes and a medium which is energized into a light-emitting plasma by electrical energy supplied by a source of AC power in alternating half-cycles of AC voltage and AC current and conducted on power conductors through a lamp circuit which includes a ballast connected to the lamp, the control system comprising:

a dimming controller adapted to be connected to the power conductors at a location remote from the fluorescent lamp and operative to generate a first control signal indicative of a request to increase the illumination intensity of the fluorescent lamp and to generate a second control signal indicative of a request to decrease the illumination intensity of the fluorescent lamp, the dimming controller transmitting the control signals over the same power conductors of the lamp circuit which conduct the electrical energy to energize the medium into light-emitting plasma;

a control module adapted to be connected to the lamp cathodes and to the power conductors at a location remote from the dimming controller and adapted to receive the control signals transmitted from the dimming controller over the power conductors, the control module changing the illumination intensity of the lamp by selectively varying the portion of each half-cycle of applied AC power during which the medium is energized into the plasma, the control module increasing and decreasing the portion of each half cycle during which the medium is energized into the plasma in response to receiving the first and second control signals, respectively; and the dimming controller responds to a user selected input actuation and generates the first and second control signals in response thereto.

15. A method of controlling the illumination intensity of a fluorescent lamp having cathodes and a medium which is energized into a light-emitting plasma by electrical energy supplied by a source of AC power delivered on power conductors in alternating half-cycles or AC voltage and AC current through a lamp circuit which includes a ballast connected to the lamp, said method comprising the steps of:

generating a first control signal on the lamp circuit power conductors at a location remote from the lamp, the first signal indicative of a request to increase the illumination intensity of the fluorescent lamp;

generating a second control signal on the lamp circuit power conductors at a location remote from the lamp, the second signal indicative of a request to decrease the illumination intensity of the fluorescent lamp;

conducting the first and second remotely generated control signals over the power conductors which conduct the electrical power that energizes the medium into the light-emitting plasma:

increasing the illumination intensity of the lamp in response to receiving the first control signal conducted over the power conductors to the lamp; and decreasing the illumination intensity of the lamp in response to receiving the second control signal conducted over the power conductors to the lamp.

16. A method as defined in claim 15 further comprising the steps of:

generating a third control signal on the lamp circuit at a location remote from the lamp which is indicative of a request to cease changing the illumination intensity of the fluorescent lamp; and ceasing a change in the illumination intensity of the lamp in response to receiving the third control signal.

17. A method of controlling the illumination intensity of a fluorescent lamp having cathodes and a medium which is energized into a light-emitting plasma by electrical energy supplied by a source of AC power in alternating half-cycles of AC voltage and AC current through a lamp circuit which includes a ballast connected to the lamp, said method comprising the steps of:

generating a first control signal on the lamp circuit at a location remote from the lamp which is indicative of a request to increase the illumination intensity of the fluorescent lamp;

generating a second control signal on the lamp circuit at a location remote from the lamp which is indicative of a request to decrease the illumination intensity of the fluorescent lamp;

increasing the illumination intensity of the lamp in response to receiving the first control signal at the lamp;

decreasing the illumination intensity of the lamp in response to receiving the second control signal at the lamp;

establishing a value indicative of a desired illumination intensity from the lamp;

storing a value indicative of the present illumination intensity of the lamp at a location in the lamp circuit remote from the lamp;

determining any difference between the present illumination intensity value and the desired illumination intensity value; and regulating the illumination intensity of the fluorescent lamp to the desired illumination intensity by generating one of the first control signal or the second control signal in response to any determined difference.

18. A method of controlling the illumination intensity of a fluorescent lamp having cathodes and a medium which is energized into a light-emitting plasma by electrical energy supplied by a source of AC power in alternating half-cycles of AC voltage and AC current through a lamp circuit which includes a ballast connected to the lamp, said method comprising the steps of:

generating a first control signal on the lamp circuit at a location remote from the lamp which is indicative of a request to increase the illumination intensity of the fluorescent lamp;

generating a second control signal on the lamp circuit at a location remote from the lamp which is indicative of a request to decrease the illumination intensity of the fluorescent lamp;

increasing the illumination intensity of the lamp in response to receiving the first control signal at the lamp;

decreasing the illumination intensity of the lamp in response to receiving the second control signal at the lamp;

interrupting the AC power supplied by the AC power source to the fluorescent lamp for one of a first predetermined time duration and a second predetermined different time duration at a location remote from the lamp;

sensing an interruption in the AC power supplied to the lamp;

measuring the time duration of the interruption in power supplied to the lamp; and decoding the measured time duration of the power interruption into one of the first or second control signals.

19. A method of controlling the illumination intensity of a fluorescent lamp having cathodes and a medium which is energized into a light-emitting plasma by electrical energy supplied by a source of AC power in alternating half-cycles of AC voltage and AC current through a lamp circuit which includes a ballast connected to the lamp, said method comprising the steps of:

generating a first control signal on the lamp circuit at a location remote from the lamp which is indicative of a request to increase the illumination intensity of the fluorescent lamp;

generating a second control signal on the lamp circuit at a location remote from the lamp which is indicative of a request to decrease the illumination intensity of the fluorescent lamp;

increasing the illumination intensity of the lamp in response to receiving the first control signal at the lamp;

decreasing the illumination intensity of the lamp in response to receiving the second control signal at the lamp:

igniting the plasma during each half-cycle of applied AC power by creating an ignition pulse and applying the ignition pulse to the medium;

extinguishing the lamp during each half-cycle of applied AC power when the lamp is ignited by reducing the voltage between the cathodes to a value less than a characteristic operating voltage at a predetermined extinguishing point in the half-cycle of applied power;

establishing the extinguishing point at an occurrence point prior to a zero crossing of the applied AC current cycle in which the lamp was illuminated; and adjusting the extinguishing point within each half-cycle of applied AC current in response to receiving one of the first control signal and the second control signal.

20. A method as defined in claim 19 further comprising the steps of:

moving, in response to receiving the first control signal, the extinguishing point to a point later in time within each half-cycle to increase the illumination intensity of the lamp; and moving, in response to receiving the second control signal, the extinguishing point to a point earlier in time within each half-cycle to decrease the illumination intensity of the lamp.

21. A control system for use in controlling the illumination intensity of a fluorescent lamp having cathodes and a medium which is energized into a light-emitting plasma by electrical energy supplied by a source of AC power in alternating half-cycles of AC voltage and AC current and conducted on power conductors through a lamp circuit which includes a ballast connected to the lamp, the lamp controller comprising:

a dimming controller adapted to be connected to the power conductors at a location remote from the fluorescent lamp and operative to generate a first control signal indicative of a request to increase the illumination intensity of the fluorescent lamp, to generate a second control signal indicative of a request to decrease the illumination intensity of the fluorescent lamp and to generate a third control signal indicative of a request to cease varying the illumination intensity of the fluorescent lamp, the dimming controller transmitting the control signals over the same power conductors of the lamp circuit which conduct the electrical energy to energize the medium into light-emitting plasma;

a control module adapted to be connected to the lamp cathodes and to the power conductors at a location remote from the dimming controller and adapted to receive the control signals transmitted from the dimming controller over the power conductors, the control module changing the illumination intensity of the lamp by selectively varying the portion of each half-cycle of applied AC power during which the medium is energized into the plasma, the control module increasing and decreasing the portion of each half cycle during which the medium is energized into the plasma in response to receiving the first and second control signals, respectively;

the control module ceases varying the portion of each half-cycle during which the medium is energized into the plasma in response to receiving the third control signal; and the dimming controller responds to a user selected input actuation and generates the first and second control signals in response thereto.

* * * * *